US005880383A

United States Patent [19]

Huff

[11] Patent Number: 5,880,383

[45] **Date of Patent: *Mar. 9, 1999**

[54] VIBRATO ASSEMBLY AND ACOUSTIC COUPLING SYSTEM FOR STRINGED INSTRUMENTS

[76] Inventor: Richard E. Huff, 1408 Solana Dr., Belmont, Calif. 94002

[ * ] Notice: The term of this patent shall not extend beyond the expiration date of Pat. No. 5,435,219.

[21] Appl. No.: 798,061

[22] Filed: Feb. 11, 1997

Related U.S. Application Data

[63] Continuation-in-part of Ser. No. 521,373, Jul. 24, 1995, Pat. No. 5,602,352, which is a continuation-in-part of Ser. No. 287,119, Aug. 8, 1994, Pat. No. 5,435,219.

[51] Int. Cl.[6] ..... G10D 3/00

[52] U.S. Cl. ..... 84/313

[58] Field of Search ..... 84/313, 291, 298, 84/307

[56] References Cited

U.S. PATENT DOCUMENTS

| | | | |
|---|---|---|---|
| 4,285,262 | 8/1981 | Scholz | 84/313 |
| 4,510,489 | 4/1985 | Anderson, III et al. | 340/572 |
| 4,510,490 | 4/1985 | Anderson, III et al. | 340/572 |
| 4,911,054 | 3/1990 | McClish | 84/725 |
| 5,019,801 | 5/1991 | Anderson, III | 340/522 |

FOREIGN PATENT DOCUMENTS

| | | |
|---|---|---|
| 096 182 | 12/1983 | European Pat. Off. . |
| 0318875 | 7/1989 | European Pat. Off. . |
| 0338696 | 10/1989 | European Pat. Off. . |
| 1154277 | 12/1963 | Germany . |
| 1533487 | 9/1970 | Germany . |
| 2709626 | 7/1978 | Germany . |
| 3705893 | 5/1993 | Germany . |
| 61-183453 | 8/1986 | Japan . |
| 63-60264 | 3/1988 | Japan . |
| WO 88/01427 | 2/1988 | WIPO . |
| 9314474 | 7/1993 | WIPO . |
| 9314478 | 7/1993 | WIPO . |

*Primary Examiner*—William M. Shoop, Jr.
*Assistant Examiner*—Shih-yung Hsieh
*Attorney, Agent, or Firm*—Limbach & Limbach LLP

[57] ABSTRACT

A vibrato assembly for stringed instruments makes slight and rapid changes in the pitch of the tone produced by a stringed instrument. The vibrato assemblies described herein use flexures to permit movement of an armature relative to a fixed base to produce variations in the tension of the strings and thereby the pitch of the tones. These flexure vibrato assemblies have the advantages of high strength, zero operational noise and rumble, and virtually zero friction and hysteresis. Additionally, flexure vibrato assemblies provide a robust path between the instrument and the strings resulting in improved tonal quality, range, and sustain. A modular flexural pivot is especially useful as the flexure of the present invention.

15 Claims, 20 Drawing Sheets

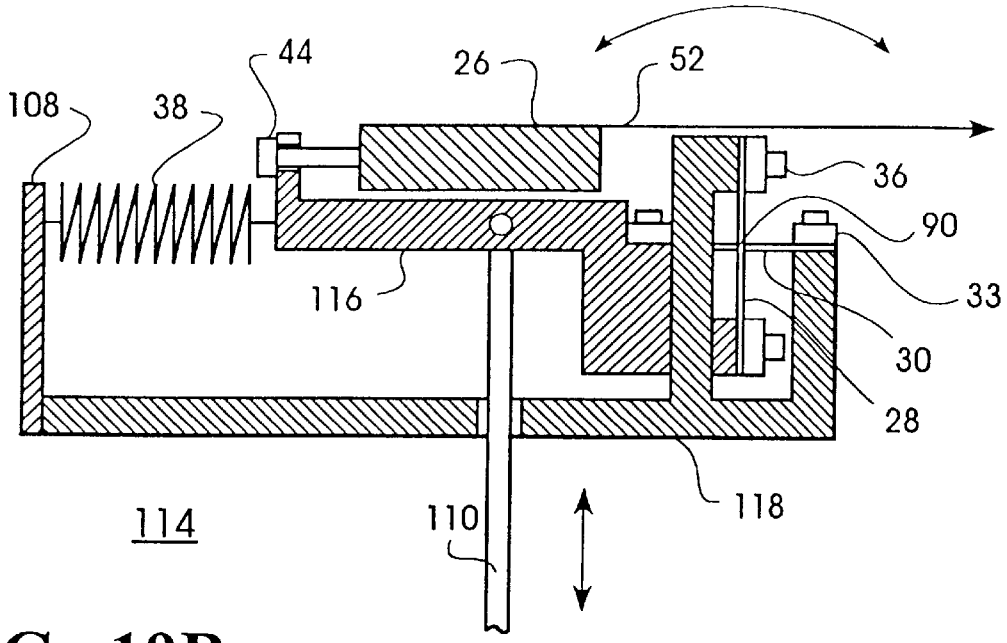
FIG. 19B
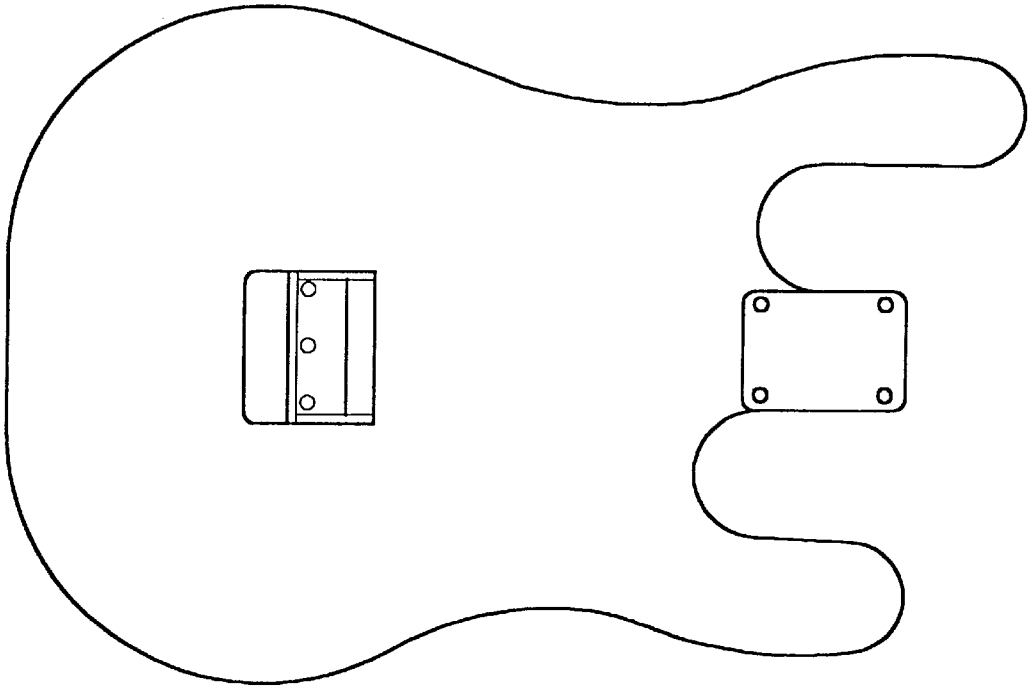
FIG. 20 CONVENTIONAL NECK ATTACHMENT JOINT

VIBRATO ASSEMBLY AND ACOUSTIC COUPLING SYSTEM FOR STRINGED INSTRUMENTS

RELATED APPLICATIONS

This is a continuation-in-part of a application, Ser. No. 08/521,373, now U.S. Pat. No. 5,602,352, entitled "Vibrato Assembly And Acoustic Coupling System For Stringed Instruments," filed on Jul. 24, 1995, which was a continuation-in-part of an earlier application, Ser. No. 08/287,119, now U.S. Pat. No. 5,435,219, entitled "Vibrato Assembly For Stringed Instruments," filed on Aug. 8, 1994, and both incorporated herein by reference.

FIELD OF THE INVENTION

This invention relates to stringed instruments and more particularly to acoustic coupling of stringed instruments and creating a vibrato effect in stringed instruments.

BACKGROUND OF THE INVENTION

In a stringed instrument, the vibration of the strings consists of transverse deflections (waves) that propagate longitudinally (i.e., along the length of the strings) in both directions. The motion of the strings in the surrounding air converts their elastic and kinetic energy into acoustic radiation and heat. Thus, the transverse waves are attenuated as they propagate along the strings.

At the ends of the strings, some acoustic power is transmitted into the supporting structure due to its slight elasticity. However, an acoustic impedance mismatch between a string and the structure generally causes a large fraction of the power in the incident waves to be reflected from each anchor point as waves travelling in the opposite direction along the string.

The strings are themselves inefficient acoustic radiators, but they do produce some air-borne sound directly. Although most of this sound radiates away from the instrument, some radiates onto its surface. A severe mismatch of the acoustic impedance of the solid surface and that of air causes most of the incident acoustic power to be reflected from the surface and back into the air. Therefore, only a very small amount of acoustic power is transmitted to the structure in this way.

In the structure, acoustic power is dissipated by radiation from the surface into the surrounding air and by internal damping (friction). A small amount of acoustic power is transmitted from the structure back into the strings through the anchor points. Reabsorption of airborne sound by the strings is negligible.

The flow of acoustic energy in a stringed instrument is shown schematically in FIG. 7. The circles labeled 120, 122, and 124 represent the strings, supporting structure, and air, respectively. The heavy (wide) and light (narrow) lines represent the primary and secondary acoustic power transmission paths, respectively. The broken (dashed) circle 125 and lines represent an optional electronic pickup (vibration transducer) and its primary and secondary acoustic inputs, respectively. It is assumed that the pickup is attached to the structure (as in conventional electric guitars) and is thus primarily sensitive to structure-borne sound. (Electromagnetic pickups sense string motion rather than structural vibration.)

In the structure, acoustic (elastic) waves can propagate along many different paths. The acoustic attenuation depends on the medium, path, and frequency. Hence, the materials and geometry of the structure influence the acoustic attenuation as a function of frequency which in turn determines the "tonal quality" or "tonality" of the instrument. (Tonal characteristics that musicians consider desirable depend, to a certain extent, on the style of music.) Multiple acoustic paths can also cause destructive interference (phase cancellation) of desirable frequencies. This effect is referred to as "multipath distortion".

It is thus apparent that acoustic coupling between the strings and the supporting structure and within the structure itself affects the quality of an "acoustic" (unamplified) instrument. In the case of an "electric" (amplified) instrument, its importance can be paramount. An acoustic coupling consideration of particular importance pertains to vibrato.

Vibrato is a slightly tremulous effect imparted to an instrumental tone for added warmth and expressiveness, consisting of slight and rapid variations in the pitch of the tone being produced. Stringed instruments, such as guitars, violins, violas, cellos, double basses, banjos, mandolins, together with a few other instruments such as trombones, are unique in allowing the musician to produce any of a continuum of musical pitches by making slight variations in the position of fingers or in the configuration of the instrument. Among stringed instruments, this has led to the development and use of techniques to produce vibrato sounds by varying the position of the fingers along the strings.

Another way to produce vibrato sounds is by using a vibrato assembly that varies the tension of the strings while the fingers remain stationary. A conventional vibrato assembly (often called a tremolo tailpiece even though in stringed instruments tremolo usually refers to variations in the amplitude rather than in the pitch of the tone produced) has a bridge that rotates relative to the body of the stringed instrument about a knife-edge hinge or rolling ball bearings to produce variations in the tension of the strings and thereby variations in the pitch of the tone.

Previously known vibrato assemblies have several disadvantages. Knife-edge hinges and rolling ball bearings have friction that can produce wear on the pivoting surfaces and cause hysteresis (i.e., prevent the strings from returning precisely to their basic pitch). The pivoting of knife-edge hinges and rolling ball bearings produces undesirable noise and rumbling sounds that nearby electro-acoustic pickups on electric stringed instruments detect and transmit to the amplifier. Knife-edge hinges and rolling ball bearings allow acoustic micro slip (i.e., sliding friction in the transmission of elastic strain waves) that prevents the efficient transfer of acoustic energy between the strings and the instrument body. This results in a loss of tonal quality (i.e., the number and relative intensity of the harmonics), frequency range, and sustain (i.e., an absence of energy loss that allows the string to vibrate freely). Also, because of the high line-contact or point-contact stresses present, even slight overloads can damage knife edges or ball-bearing races and thus cause increased friction, noise, and acoustic losses.

For the reasons previously discussed, it would be advantageous to reduce multiple acoustic paths that cause destructive interference and distortion and to selectively alter the acoustic attenuation. Additionally, it would be advantageous to have a vibrato assembly for stringed instruments that exhibits no wear or hysteresis, does not create extraneous noise, efficiently transfers acoustic energy from the strings to the instrument body, and withstands rugged use.

SUMMARY OF THE INVENTION

In accordance with the illustrated preferred embodiments, the present invention includes an acoustic coupling plate that extends from the bridge or vibrato assembly to the neck of the instrument. It acoustically couples the strings, the neck, the instrument body, and the bridge or vibrato assembly. It acts as an acoustic waveguide to reduce multipath distortion and can be used to alter the tonality of the instrument. The acoustic coupling plate can be divided into two plates and shaped to produce desirable damping characteristics (as a function of frequency). One plate acoustically couples the instrument body to the bridge/vibrato and a second plate acoustically couples the neck to the instrument body.

The present invention also includes a vibrato assembly in which all relative motion between its parts is achieved by means of elastic flexural members. It is applicable to instruments having one or more strings. It has a vibrato base attached to the instrument (e.g., the body or the neck of the instrument), a vibrato armature means for supporting a string, and an elastic flexure pivot for allowing relative movement between the vibrato base and vibrato armature that varies the tension of the string. (The present use of the term "armature" is consistent with its use as the name of the moving part in wire strain gages, electromechanical relays, etc.) An instrument can have a single vibrato that varies the tension of all the strings or the instrument may have multiple vibratos, as many as one per string, each varying the tension of a subset of the strings. The present invention includes mounting the vibrato assembly to the acoustic coupling plate.

The acoustic coupling plate and vibrato assembly are effective individually, but are synergistic in combination. The present invention includes mounting the vibrato assembly to the acoustic coupling plate or an integral construction.

The acoustic coupling plate of the present invention has numerous advantages. It reduces distortion caused by multiple acoustic paths, alters the tonality of an instrument, and increases the versatility of a single instrument by enabling it to have a different tonality with just a change of the acoustic coupling plates. As an additional advantage, the strength of the plate permits the neck to be tapered for easy access to frets on the body of the instrument.

The vibrato assembly of the present invention provides a robust path for the transmission of acoustic waves from the vibrating strings to the instrument body with minimal attenuation (energy loss) and distortion, resulting in improved tonal quality, range, and sustain. The absence of any sliding or rolling contact eliminates the problems of friction and wear. The lack of surface friction coupled with the inherent restoring moment of the flexure pivots results in very low hysteresis. If suitable materials are employed, the hysteresis will be essentially zero—the strings will return exactly to their basic pitch. The operational noise of high-quality flexure pivots is negligible in comparison with that of knife-edge hinges and rolling ball bearings and is undetectable by conventional electro-acoustic pickups. Also, the vibrato assembly can be made sufficiently rugged to withstand accidents and abuse without performance degradation. An additional advantage of the present invention is that tonal characteristics can be altered by employing different materials.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

FIG. 19B is a cross-sectional side view of the FIG. 19A embodiment of an individually actuated vibrato.

FIG. 20 is a plan view that shows a conventional attachment joint for a neck.

DETAILED DESCRIPTION OF THE PREFERRED EMBODIMENTS

FIGS. 1 through 28 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
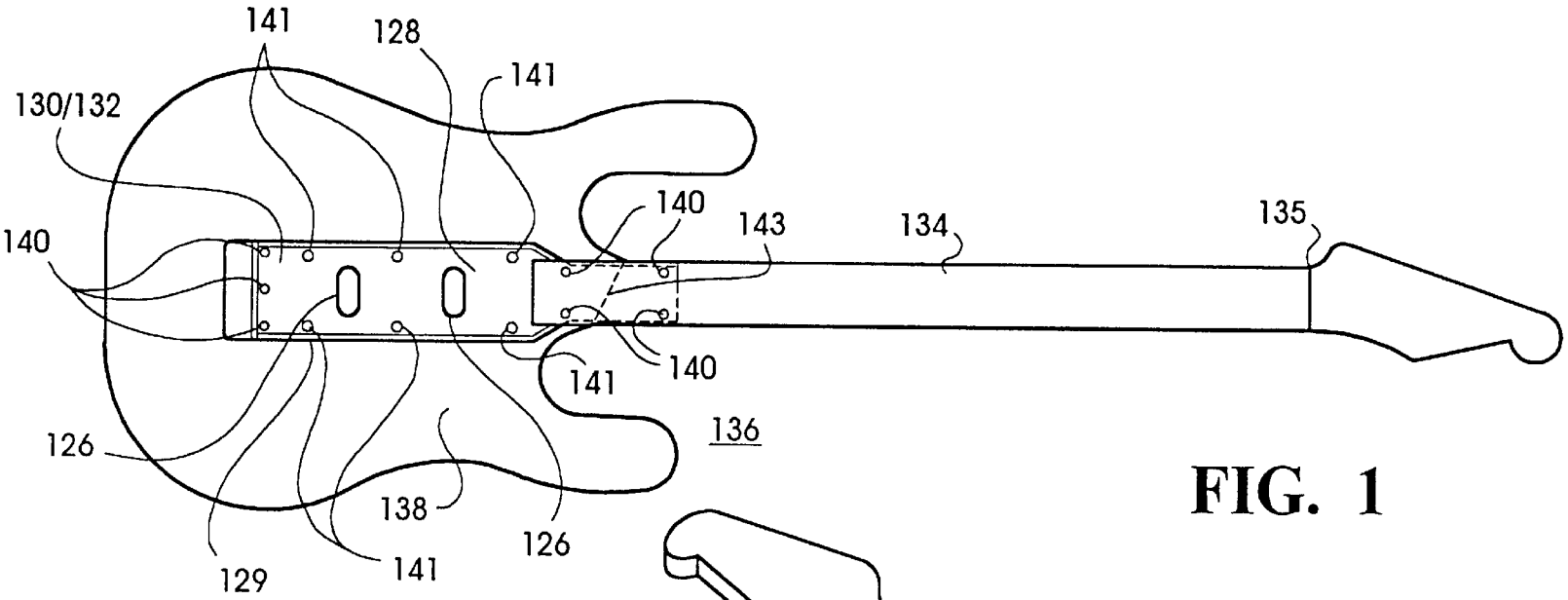
FIG. 1 is a plan view that shows a preferred embodiment of an acoustic coupling system of the present invention.

FIG. 1 shows a preferred embodiment of the acoustic coupling system of the present invention. It has an acoustic coupling plate 128 that extends from either a fixed bridge 130 or a vibrato 132 (vibrato 132 can be any type of vibrato including those previously known, those described on the following pages, and those that will be created in the future) to neck 134 of instrument 136 to directly couple the bridge/vibrato, neck, and strings. In the preferred embodiment of the invention, acoustic coupling plate 128 extends over the portion of neck 134 that attaches to instrument body 138. In alternative embodiments, acoustic coupling plate 128 could cover a larger portion or all of neck 134. Fasteners 140, such as bolts, attach acoustic coupling plate 128 to instrument neck 134 and fasteners 141 attach acoustic coupling plate 128 to instrument body 138. Adhesive bonding could also be used. Steel is the preferred material for the coupling plate(s), although other materials such as other metals or composite materials could also be used. Electronic pickups 126 are located on instrument body 138 beneath acoustic coupling plate 128.

In the preferred embodiment of the invention, acoustic coupling plate 128 has radiused edges 129 because acoustic energy reflects off the rounded edges better than it reflects off square corners. In the preferred embodiment of the invention, instrument body 138 has a hollowed out compartment to receive acoustic coupling plate 128. These hollowed-out spaces can have radiused edges too.

Acoustic coupling plate 128 acts as an acoustic waveguide that channels the acoustic waves along a path between neck 134 and fixed bridge/vibrato 130/132 on instrument body 138 so all acoustic waves have paths of approximately the same length. Without acoustic coupling plate 128, the acoustic energy will travel throughout instrument body 138 on many different paths of many different lengths. When these acoustic waves collide, there may be destructive or constructive interference. Destructive interference occurs when out-of-phase acoustic waves collide. Destructive interference does not destroy energy but if the waves collide when they are 180° out-of-phase, then they will cancel each other at that location. An advantage of the acoustic coupling plate 128 is that acoustic waves have approximately the same path and the same path length so that they are in-phase when they collide and thereby create very little distortion.

Acoustic coupling plate 128 affects the tonality of stringed instruments by changing the damping characteristic of the instruments. Wood has a high coefficient of damping. In the preferred embodiment of the invention, acoustic coupling plate 128 is made from steel that has a low damping coefficient and a stringed instrument using this acoustic coupling plate will have a bell-like tone. Alternative embodiments of the invention may use hardened steel which has a very low damping coefficient and little acoustic attenuation. Other embodiments of the invention use a soft metal that has a higher damping coefficient for producing an instrument with more acoustic attenuation and different tonality.

Damping is frequency dependent and it can be visualized as a curve of damping versus frequency. An equation that gives the rate of decay of an acoustic wave is:

$$A = A_0 e^{-\alpha t}$$

where $\alpha$ is a function of frequency. Generally, the higher the frequency the faster it will decay.

An advantage of acoustic coupling plate 128 is that a stringed instrument designer can vary the shape and magnitude of the damping versus frequency curve to produce an instrument with the desired tonality by making the plate from a different material and/or by changing its size and shape.

Figure 2A:
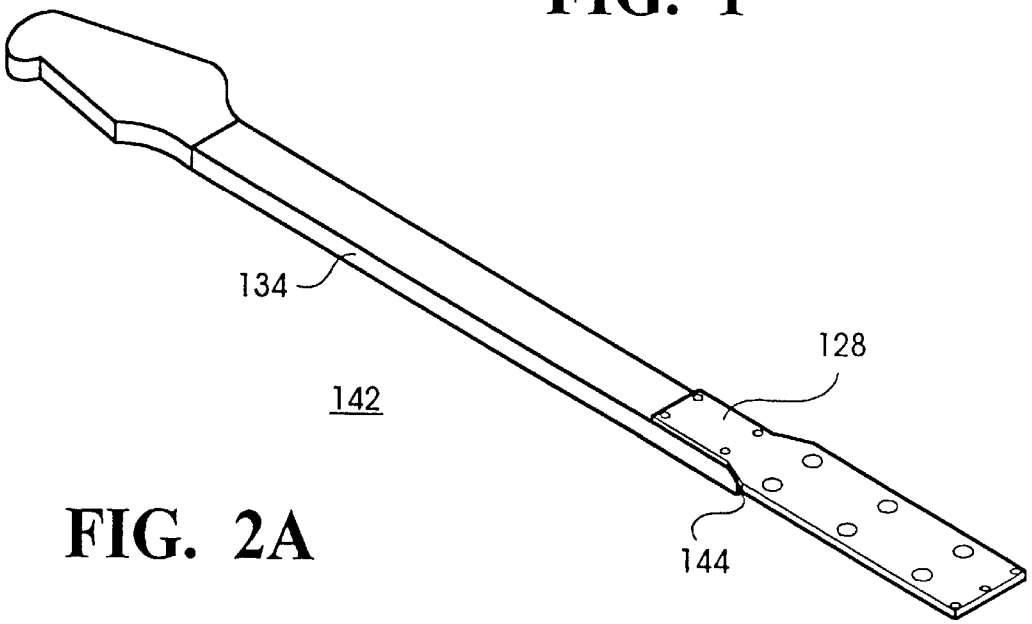
FIG. 2A is a perspective view that shows a preferred embodiment of an acoustic coupling plate and neck of a stringed instrument.
Figure 2B:
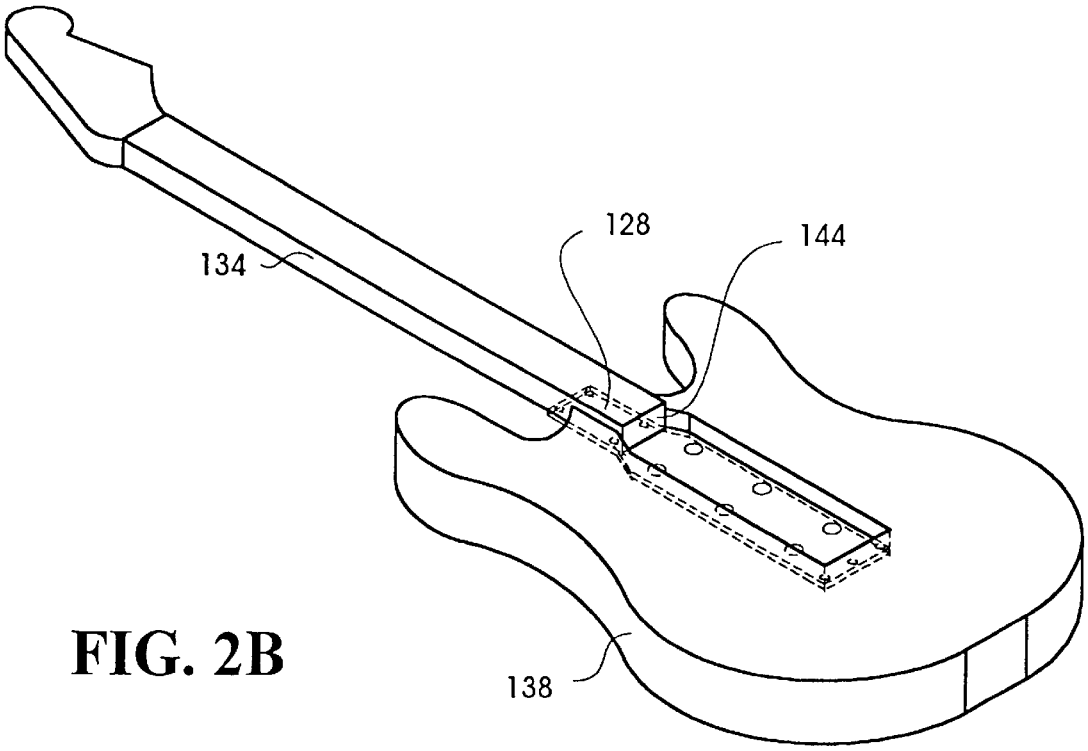
FIG. 2B is a perspective view that shows the acoustic coupling plate and neck assembly attached to an instrument body.

FIG. 2A shows the instrument subassembly 142 and FIG. 2B shows this subassembly dropped into instrument body 138 and attached to it with body fasteners 143. The strength of acoustic coupling plate 128 allows neck 134 to have a tapered portion 144. The tapered portion 144 allows the instrument player to position his or her hand so that the frets on the body of the instrument can be easily reached. Previously known guitars require the player who wants to play these frets to place his or her hands in an awkward position.

Figure 3:
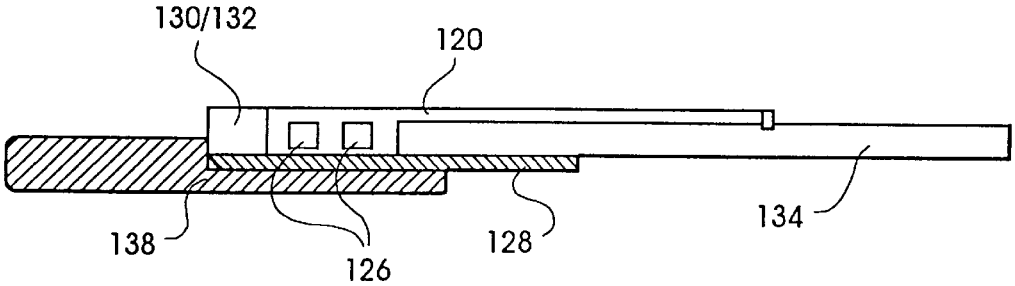
FIG. 3 is a cross section of the invention shown in FIG. 1.

FIG. 3 is an alternative embodiment of the invention that has acoustic coupling plate 128 mounted between neck 134 and instrument body 138. The fixed bridge/vibrato 130/132 attaches to acoustic coupling plate 128. Electronic pick-ups 126 are located on top of acoustic coupling plate 128.

Figure 4:
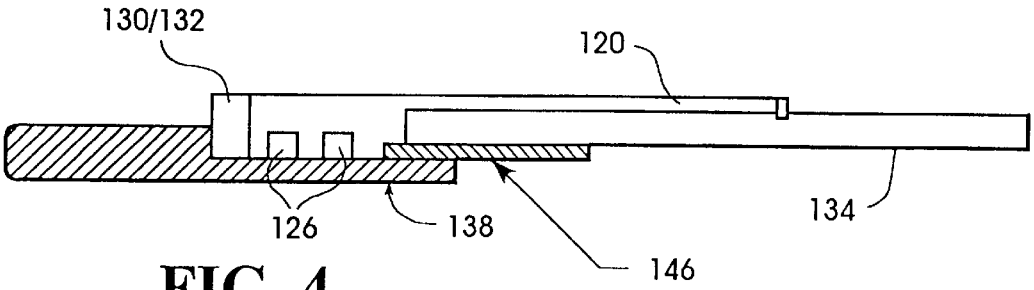
FIG. 4 shows a cross-section of an alternative embodiment of the invention using a partial acoustic coupling plate.
Figure 5:
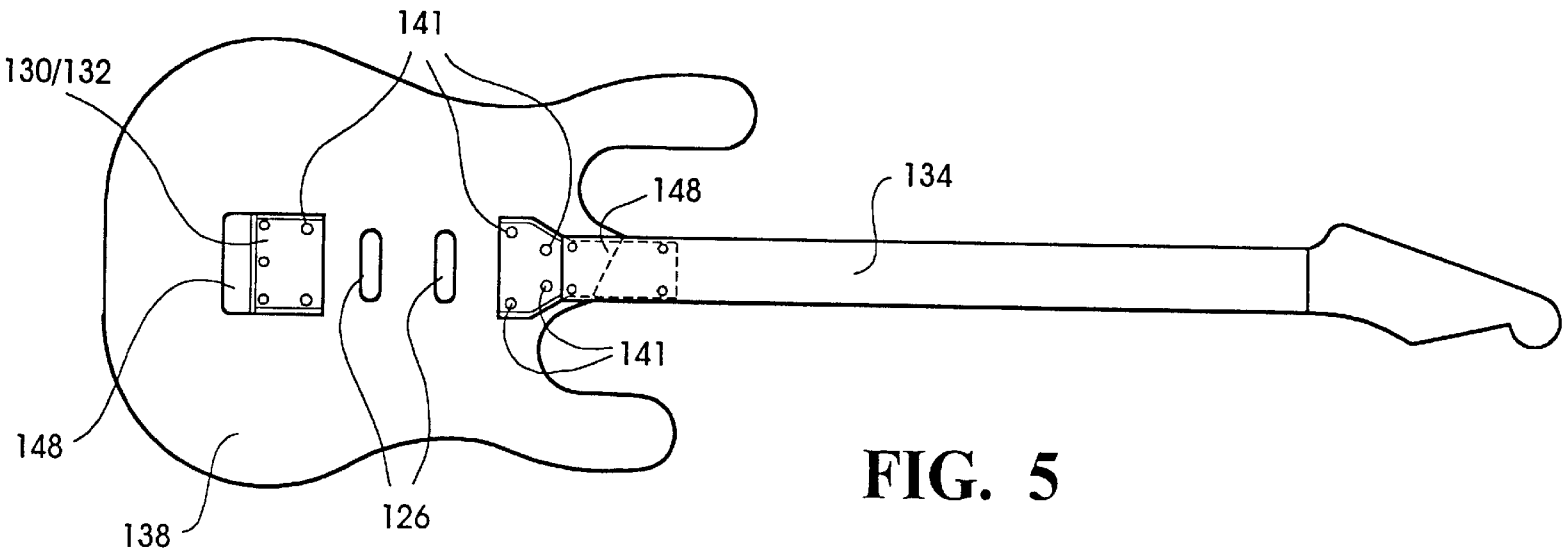
FIG. 5 is a plan view that shows an alternative embodiment of the invention having two partial acoustic coupling plates.
Figure 6:
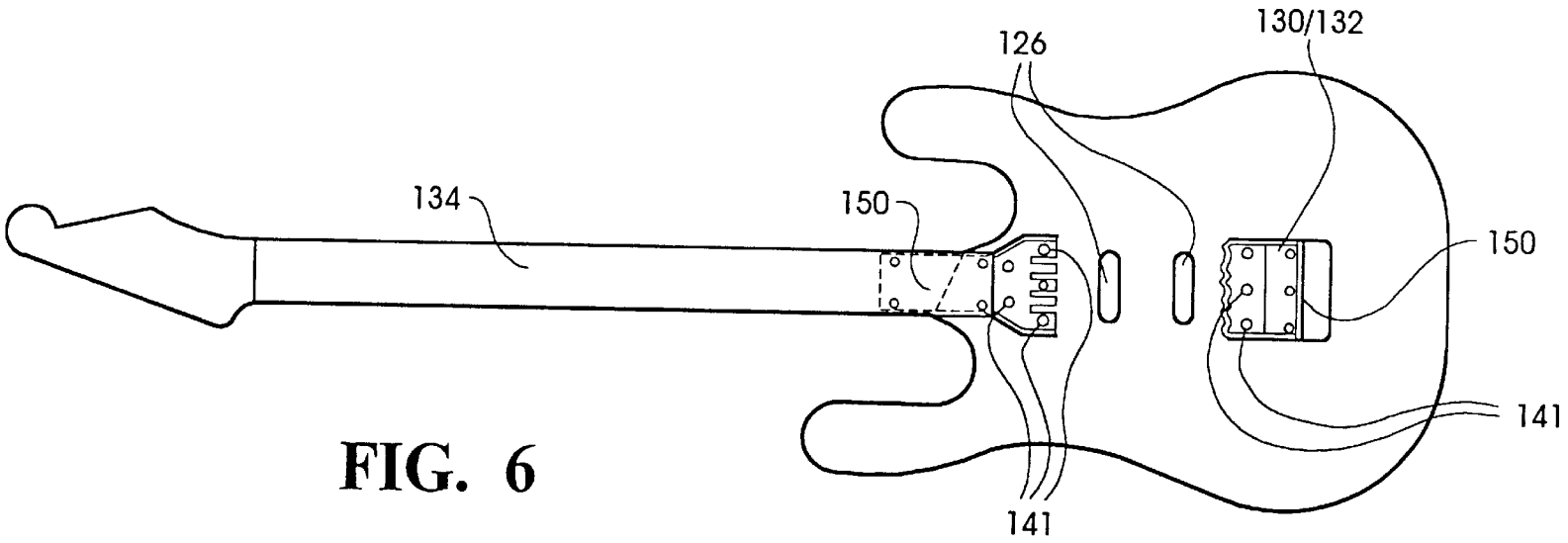
FIG. 6 is a plan view that shows an alternative embodiment of the invention having two partial acoustic coupling plates shaped to give the instrument a desired tonality.
Figure 7:
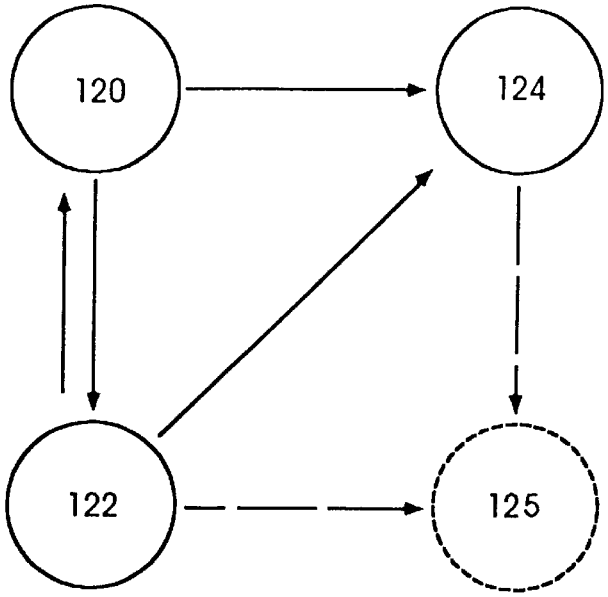
FIG. 7 is a diagram that shows the flow of acoustic energy in a stringed instrument.

FIGS. 4, 5, and 6 show alternative embodiments of the invention with a partial acoustic coupling plate 146, two partial acoustic coupling plates 148, or two shaped partial acoustic coupling plates 150. FIG. 4 shows a partial acoustic coupling plate 146. The acoustic waves will be subjected to the damping characteristics of the partial acoustic coupling plate 146 and the damping characteristics of the wood, thereby adjusting the tonality of the instrument. Additionally, partial acoustic coupling plate 146 guides the path of the acoustic waves so that they all have approximately the same path. Electronic pick-ups 126 are located on instrument body 138.

FIG. 5 shows two partial acoustic coupling plates 148. One plate acoustically couples the fixed bridge/vibrato 130/132 to instrument body 138 and the other acoustically couples neck 134 to instrument body 138. Fasteners 141 connect the acoustic coupling plate 148 to instrument body 138. This multi-plate system has the advantage of providing an acoustic waveguide to prevent destructive interference of the acoustic waves that results in distortion of the sound while altering damping characteristics of the instrument to produce an instrument of desirable tonality. Electronic pick-ups 126 are located on instrument body 138.

FIG. 6 shows two shaped partial acoustic coupling plates 150 attached to instrument body with body fasteners 141. Like two partial acoustic coupling plates 148, it has the advantage of providing an acoustic waveguide for the acoustic waves to prevent multipath distortion. The shaping of the two partial acoustic coupling plates 150 alters the tonality of the instrument. Electronic pick-up 126 is located on instrument body 138.

An advantage of the acoustic coupling device of the present invention is that the tonality of an instrument can be modified by changing the acoustic coupling plates. A string instrument could have several sets of acoustic coupling plates as well as acoustic coupling plate 128. Each set is individually shaped and constructed to cause the host stringed instrument to have a different tonality. Thus, a single stringed instrument could have a wide range of tonality.

Figure 8A:
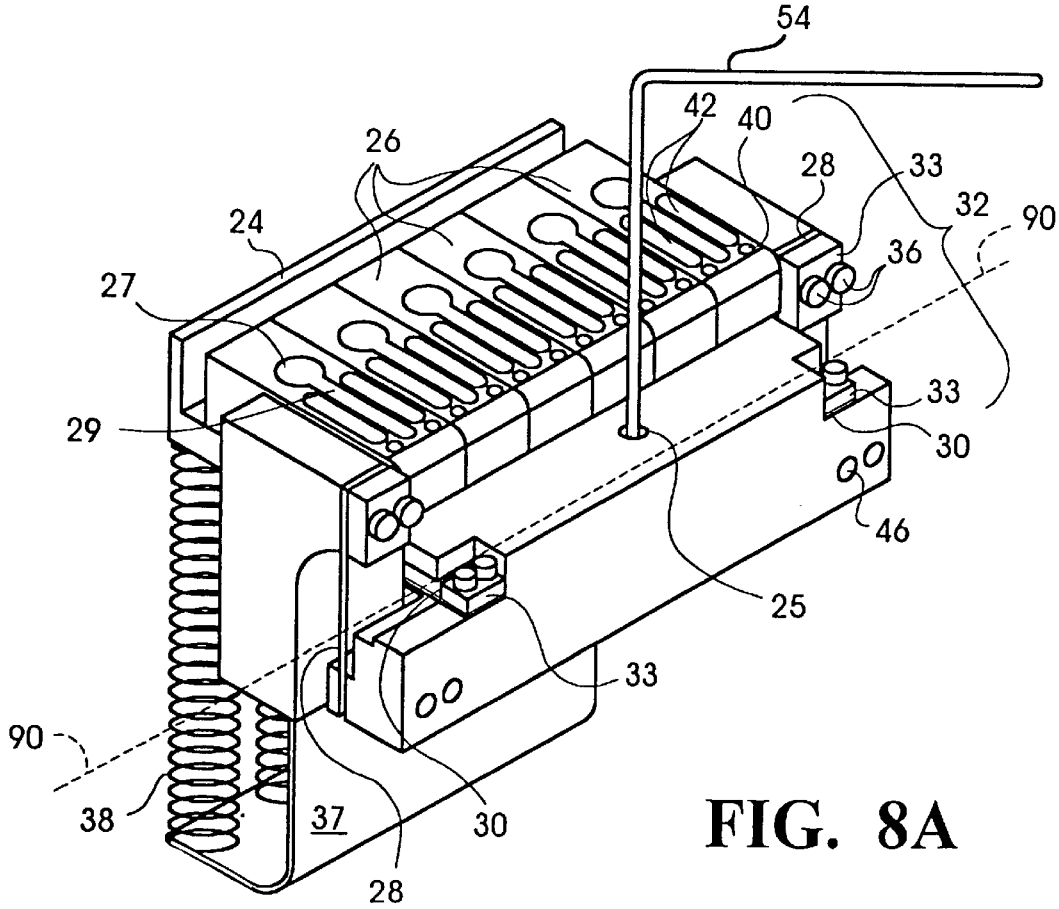
FIG. 8A is an isometric view of a preferred embodiment of the vibrato assembly of the present invention.
Figure 10:
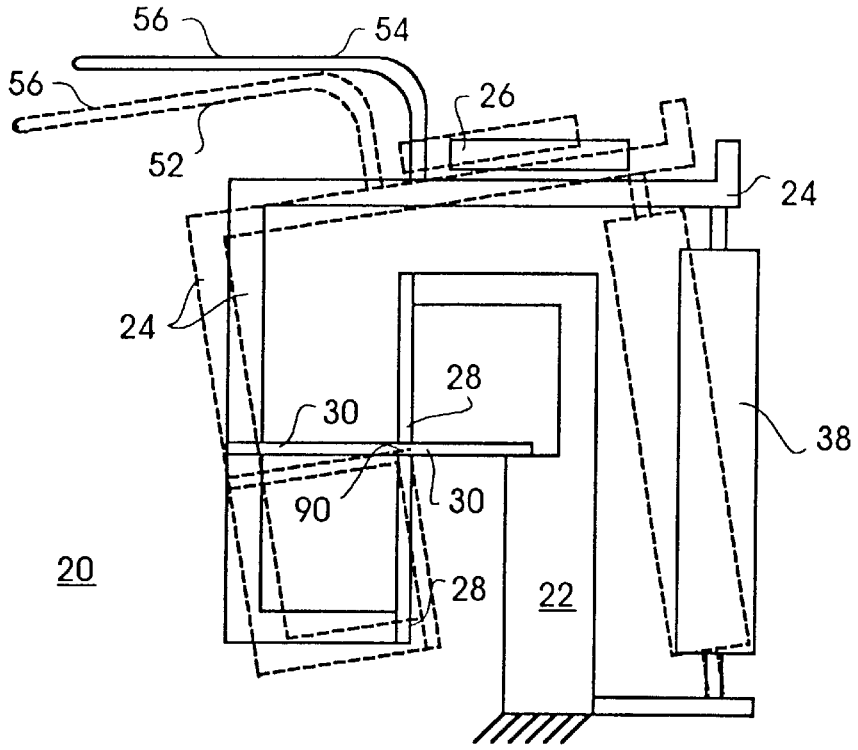
FIG. 10 is schematic side view of the vibrato assembly of the present invention showing a "rest" position (in solid lines) and a "flexed" position (in dashed lines), with an axis of rotation at the intersection of the flexure pivots.

FIG. 8A is an isometric drawing of a preferred embodiment of the vibrato assembly of the present invention. Vibrato assembly 20 has two cross-strip flexure pivot subassemblies 32 that connect a vibrato armature 24 to a vibrato base 22. Each flexure pivot subassembly 32 has a flexure plate 28 and a second flexure plate 30, each connecting vibrato base 22 to vibrato armature 24. Vibrato base 22 mounts on the stringed instrument and remains stationary when an actuating force operates on vibrato armature 24. Vibrato armature 24 responds to the actuating force by moving and varying the tensions of the strings. FIG. 10 shows that in the preferred embodiment the actuating force acts on vibrato armature 24, but the scope of the invention includes the application of actuating forces to any part of vibrato assembly 20.

When the actuating force acts on handle 54, flexure plate 28 and second flexure plate 30 deform to allow vibrato armature 24 to move and change the effective length and tension in strings 52. In the preferred embodiment, handle 54 is a removable lever arm that attaches to mount 25 shown in FIG. 8A and force is manually applied at handle 54 to impart the relative motion between vibrato armature 24 and vibrato base 22. The scope of the invention includes all types of handles and the use of a mechanical actuator to impart the relative motion.

Figure 8B:
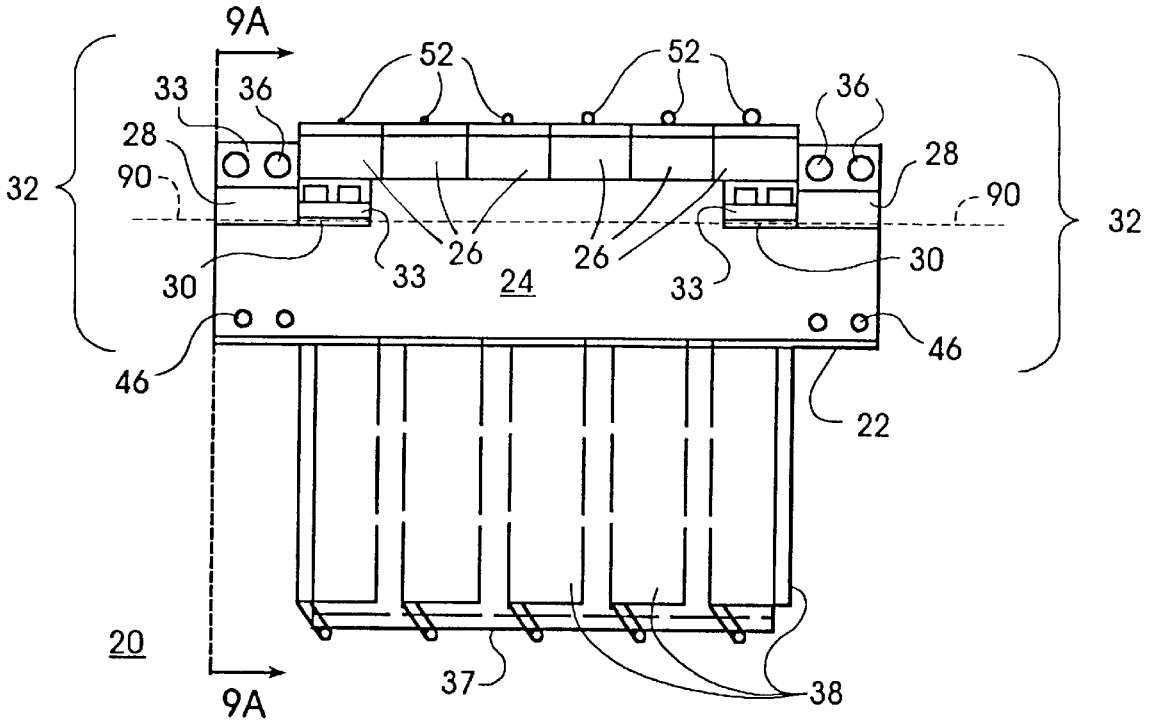
FIG. 8B is a front view of the embodiment of FIG. 8A.

FIG. 8B is a front view of vibrato assembly 20. The bottom of vibrato armature 24 is slightly elevated above the bottom of vibrato base 22. A cross-strip flexure pivot subassembly 32 attaches to either side of vibrato assembly 20. String saddles 26 for each string 52 fasten to vibrato armature 24 and move with it. In the preferred embodiment of the invention, saddles 26 and vibrato armature 24 support and anchor strings 52. The ball end of each string 52 drops through string hole 27, shown in FIG. 8A, and slides underneath a string slot 29. The scope of the invention includes embodiments in which each string 52 anchors to something else. For example, each string 52 could anchor directly to the instrument and vibrato armature 24 would merely deflect (and stretch) strings 52.

By moving vibrato armature 24, the strings 52 stretch or relax longitudinally slightly and their tension varies to create corresponding variations in the pitch of their tones. Tension springs 38 connect between vibrato armature 24 and instrument 62, as shown in FIGS. 9C, 12A, 12B, and 14, and oppose the tension in strings 52.

Figure 9A:
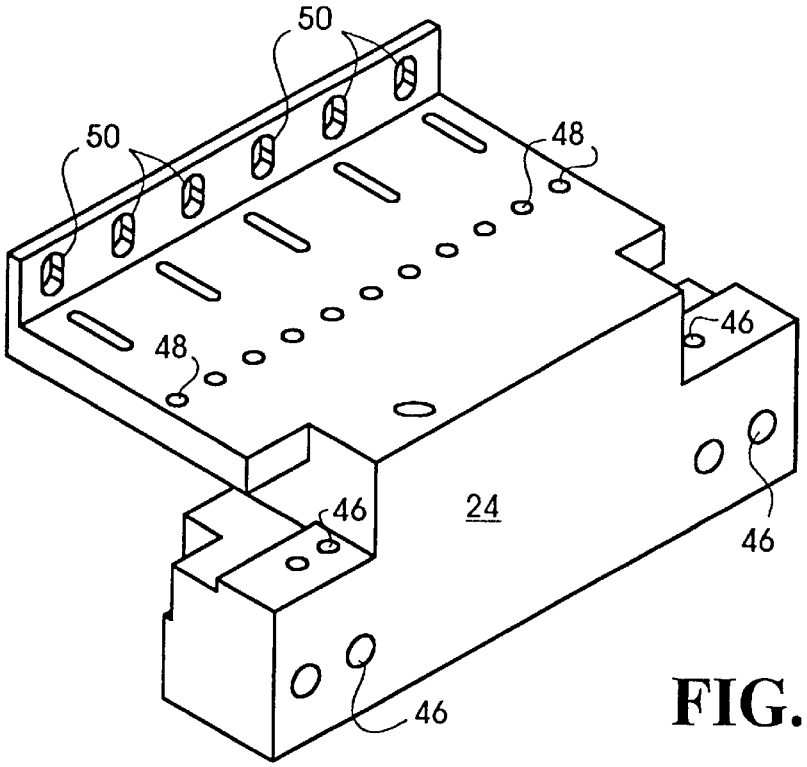
FIG. 9A is a perspective view of a vibrato armature.
Figure 9B:
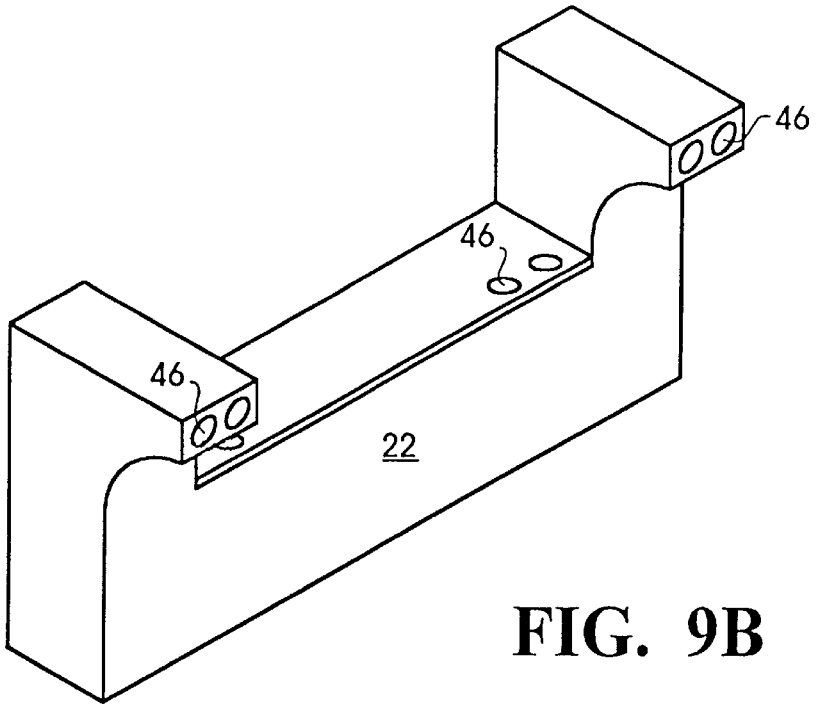
FIG. 9B is a perspective view of a vibrato base.
Figure 9C:
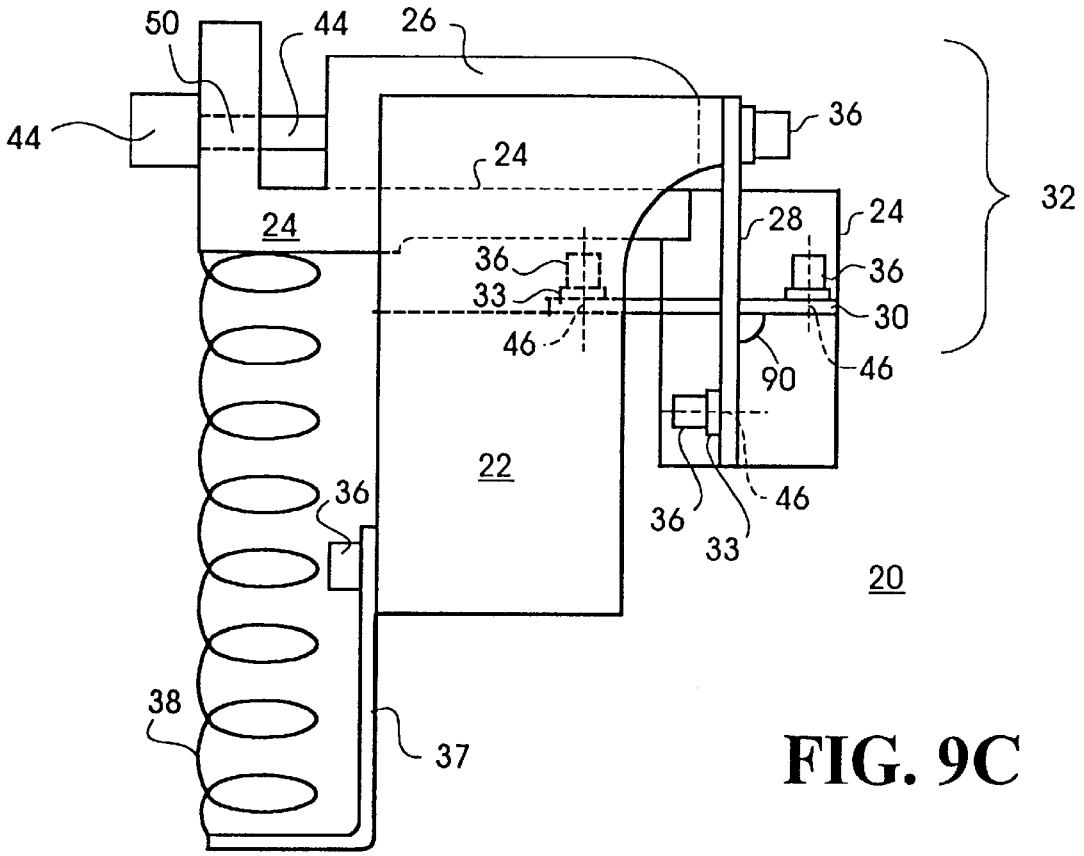
FIG. 9C is a side view of the vibrato assembly that illustrates the cross-strip flexure pivot.

Flexure pivot subassemblies 32, shown in FIGS. 8A, 8B, and 9C perform like a combination spring and bearing, but without friction. Previously known vibrato assemblies with their knife edge hinges or rolling ball bearings vary the tension in the strings by the frictional motion of one surface rolling or sliding over another. When a vibrato assembly 20 with flexure pivot subassemblies 32 moves to vary tension in the strings, one surface does not move against another. Instead, atomic bonds within flexures 28 and 30 stretch and the resulting motion is frictionless and quiet. Additionally, flexure pivot subassemblies 32 in the present invention act like center seeking springs and have virtually zero hysteresis. After termination of the actuating force on handle 54, shown in FIG. 10, the restoring forces of the stretched atomic bonds and springs 38 return vibrato armature 24 to its exact original position resulting in strings 52 producing tones at their original pitch.

It is important that the flexure plates (or strips) exhibit purely elastic behavior over the operational range of deflection. Any plastic (or viscoelastic, etc.) deformation will cause hysteresis and eventual failure of the flexure. The flexures should be made of a material capable of large purely elastic strains and fatigue resistance—typically a high strength metal (e.g., hardened tempered spring steel). If the flexures are of the clamped-spring type, it is important that the flexure plate clamp very securely because any slippage will cause hysteresis, operational noise, and acoustic losses. For ruggedness, the geometry of the vibrato base and vibrato armature should prevent bending of the flexures beyond their elastic limits. Preferably, the normal operating stresses in the flexures should not exceed approximately 25% of the yield strength, but can be as high as 30% depending on the material. Of course, higher operating stresses could be used and are within the scope of the invention, but may result in failure through fatigue.

Figure 17:
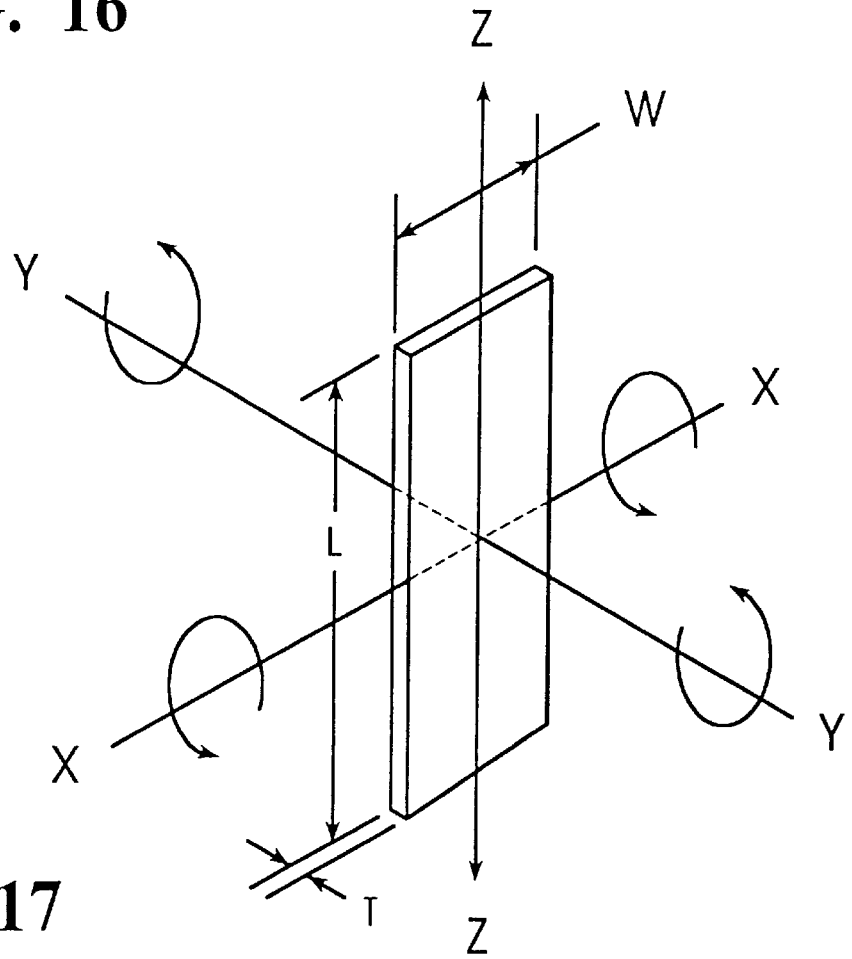
FIG. 17 is a perspective view that shows a single flexure plate and its associated coordinate system.

For large elastic bending deflections, the thickness of a flexure plate, shown as T in FIG. 17, should be much smaller than its length, L. The thickness to effective length ratio is dependent on the specific application where resistance to fatigue and/or loading is a concern. FIG. 17 shows that the plate should have low resistance to bending around the x axis, but high resistance to bending around the y axis, and high resistance to lengthening, under tension, in the z axis as shown in FIG. 17. A "cross-strip" flexure pivot subassembly employing two such plates will rotate easily about an axis parallel to (and near) the line of intersection of the planes of the two plates but will strongly resist all motion in other directions. If a vibrato assembly uses multiple flexure pivot subassemblies and/or the flexure pivot subassembly employs more than two plates, it is important that the planes of all of the plates intersect on substantially a single axis.

For a general discussion of the design and application of flexure pivots, please consult the following references: "The Design of Flexure Pivots", Journal of The Aeronautical Sciences, Volume 5, November 1937, pp. 16–21; F. S. Eastman, "Flexure Pivots to Replace Knife Edges and Ball Bearings", University of Washington Engineering Experiment Station Bulletin No. 86, November 1935; F. S. Eastman, and R. V. Jones, "Some Uses of Elasticity in Instrument Design", Journal of Scientific Instruments, Volume 39, May 1962, pp. 193–203.

In the preferred embodiment, the flexure plates 28 and 30, shown in FIG. 8A, are made of hardened beryllium copper, are approximately 0.4 mm thick and 9.5 mm wide, and have an active bending length (excluding clamped ends) of approximately 13 mm. A pivot axis 90 is formed by the intersection of the plane of flexure plates 28 with plane of flexure plates 30 and is oriented to allow the vibrato armature 24 to move in a direction to vary the tension in the strings, but not in any other direction. In normal operation, flexure pivot subassemblies 32 rotate through an angle of approximately +/−8 degrees, providing a range of string length adjustments of approximately 5 mm. A mechanical stop (not shown) will limit the angle of rotation in both directions from going beyond a specified angle that is within the 25% of yield strength rule.

Another advantage of the rigidity of flexure pivot subassemblies 32 is that they readily transfer vibrational energy from strings 52 to instrument 62 and back to strings 52 again. Vibrational energy travels from strings 52 through: saddles 26, vibrato armature 24, flexure plates 28 and 30, vibrato base 22, into instrument 62, and back into strings 52 via the same path. The free and unimpeded transfer of acoustic energy between strings 52 and instrument 62 results in improved tonal quality, range, and sustain.

FIG. 9A shows vibrato armature 24 and FIG. 9B shows vibrato base 22. Vibrato armature 24 fits over and inside vibrato base 22. FIG. 9C is a side view of vibrato assembly 20 that illustrates the connections that cross-strip flexure pivot subassembly 32 makes with vibrato base 22 and vibrato armature 24. Fasteners 36 screw into fastener holes 46 and clamp flexures 28 and 30 to vibrato armature 24 and vibrato base 22. Although the preferred embodiment of the invention has flexure 28 positioned perpendicular to saddles 26 and has flexure 30 positioned parallel to saddles 26, the scope of the invention includes any orientation of flexures 28 and 30 relative to saddles 26.

Vibrato armature 24, shown in FIG. 9A, has holes for attaching saddles 26 to it. Intonation screw holes 50 accept intonation screws 44, one of which is shown in FIG. 9C, for precisely adjusting the length of string 52, opposing the string tension, and holding the string in place. Anchoring screws go through slotted holes 42, shown in FIG. 8A; screw into anchoring holes 48, shown in FIG. 9A; mount saddles 26 to vibrato armature 24; and transfer vibrational energy to armature 24. Set screws go in set screw holes 40 (FIG. 8A) and terminate on vibrato armature 24. They position the height of saddle 26 and string 52 relative to vibrato armature 24.

FIG. 10 is a schematic drawing that shows the kinematics of vibrato assembly 20. When actuating force acts on handle 54, vibrato armature 24 moves, flexure plates 28 and 30 undergo elastic deformation, the tension in string 52 changes, and the pitch of the tone produce by string 52 changes. Upon termination of the actuating force, vibrato assembly 20 returns to its resting position indicated by the solid lines.

There are several types of flexure pivots. These include a single flexure and a cross-strip configuration employing two or more flexures. The latter provides the advantages of a well defined axis of rotation and rigidity at the expense of greater complexity. The flexures themselves are also of various forms. These include the clamped-flat-spring type, such as flexure plates 28 and 30, and the monolithic type, shown in FIG. 16. The latter precludes any possibility of friction, but is generally much more expensive to fabricate. The range of fabrication methods for the flexures in general includes, but is not limited to soldering, brazing, welding, and/or bonding the flexure plates to the vibrato base and the vibrato armature. The preferred embodiment employs two cross-strip flexure pivot subassemblies, each having two clamped-flat-spring flexures. However, the scope of the invention includes vibrato assemblies employing any number of flexure pivot subassemblies of any configuration with flexures of any type. Also, vibrato assemblies incorporating combinations of flexure pivots and conventional bearings are within the scope of the invention. A few of the many possibilities are discussed below as alternative embodiments.

Figure 11A:
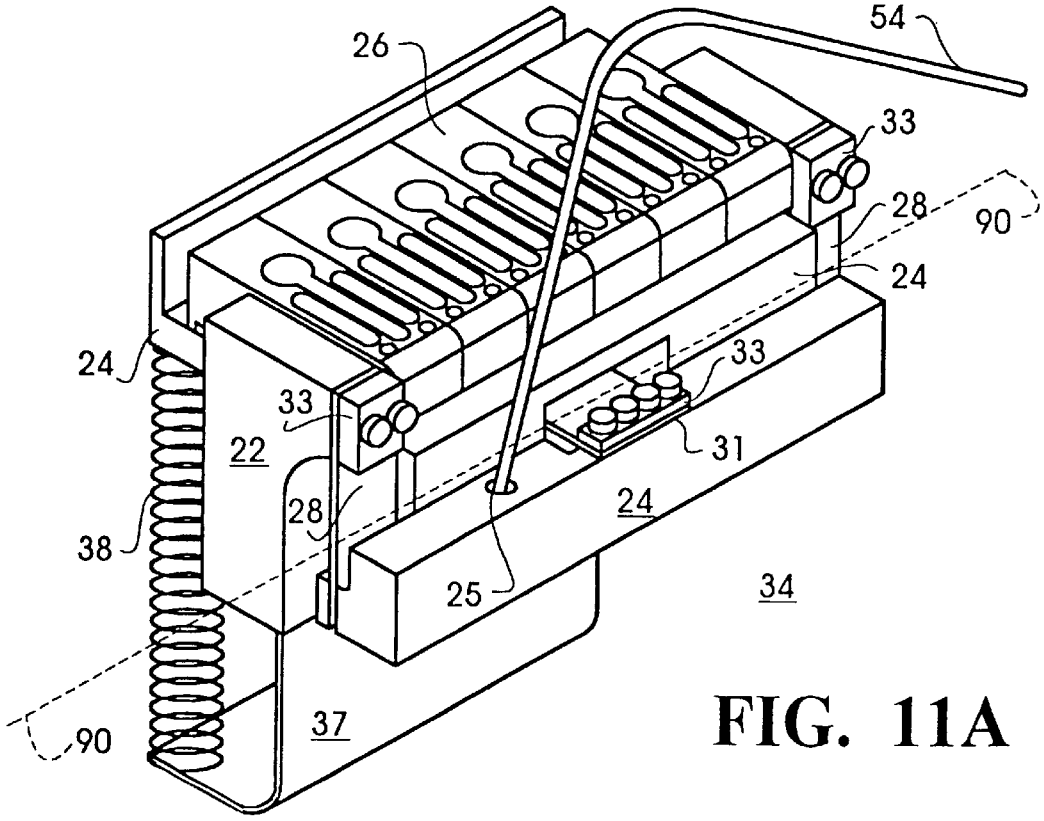
FIG. 11A is an isometric view of another embodiment of the vibrato assembly of the present invention, which uses cross-strip flexure pivots with the horizontal flexure plates moved to the center of the vibrato base and the vibrato armature.
Figure 11B:
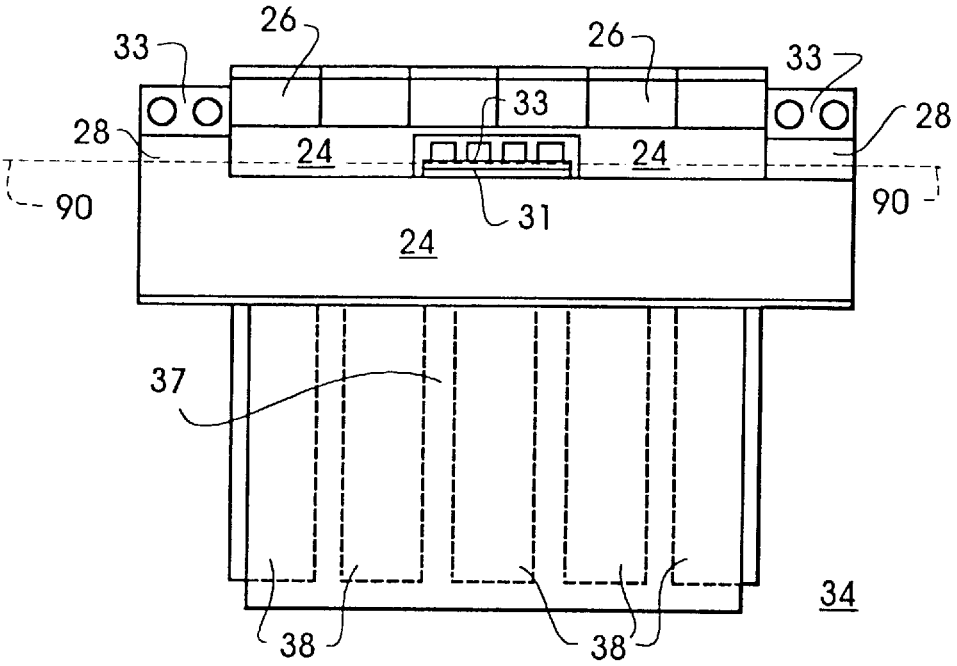
FIG. 11B is a front view of the embodiment shown in FIG. 11A.

FIGS. 11A and 11B show a three flexure plate vibrato assembly 34. This variation of cross-strip flexure pivot subassemblies 32, shown in FIG. 8A, 8B and 9C has the horizontally oriented flexures 30 of FIG. 8A and 8B moved to the center of vibrato armature 24 and vibrato base 22 where they are merged together to form flexure 31. This configuration of a cross-strip flexure pivot subassembly is illustrated again in FIGS. 19A and 19B where it is used in an individually actuated vibrato subassembly 114 that varies the tension of just one string or a subset of all the strings.

Figure 12A:
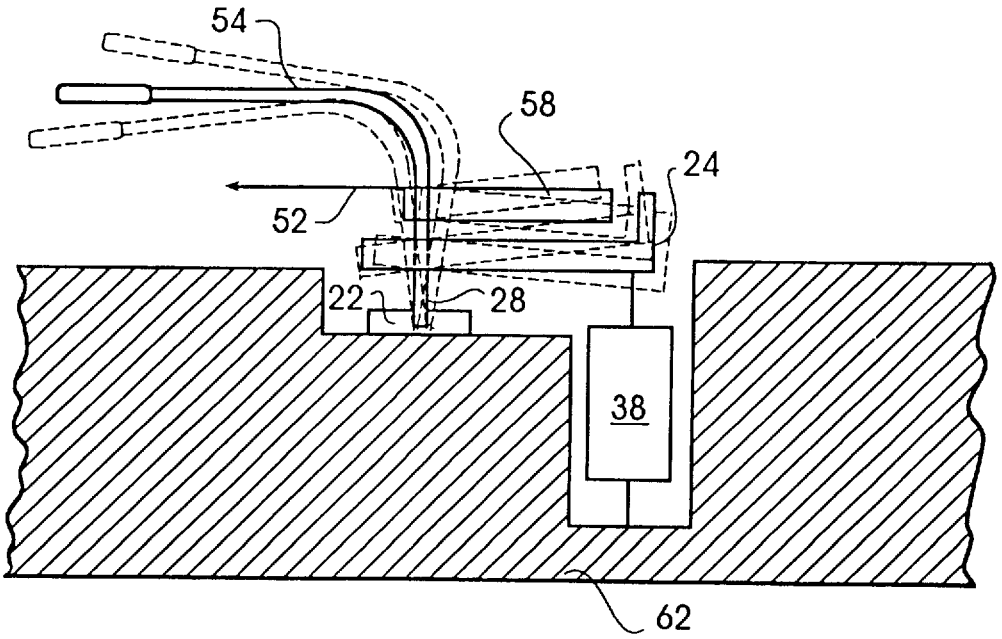
FIG. 12A is a side view that shows an alternative embodiment of the vibrato assembly of the present invention having a single flexure.

FIG. 12A is a schematic drawing of a single flexure vibrato assembly 58. Vibrato base 22 is mounted in a recess of instrument 62, a single flexure 28 connects vibrato base 22 to vibrato armature 24. When force is applied to handle 54, vibrato assembly 58 moves and the tension in string 52 varies producing variations in the pitch of its tone. Tension spring 38, connected between instrument 62 and vibrato armature 24 opposes the tension in strings 52. In this embodiment, flexure 28 is placed in compression and must have sufficient stiffness to resist buckling under the applied load.

Figure 12B:
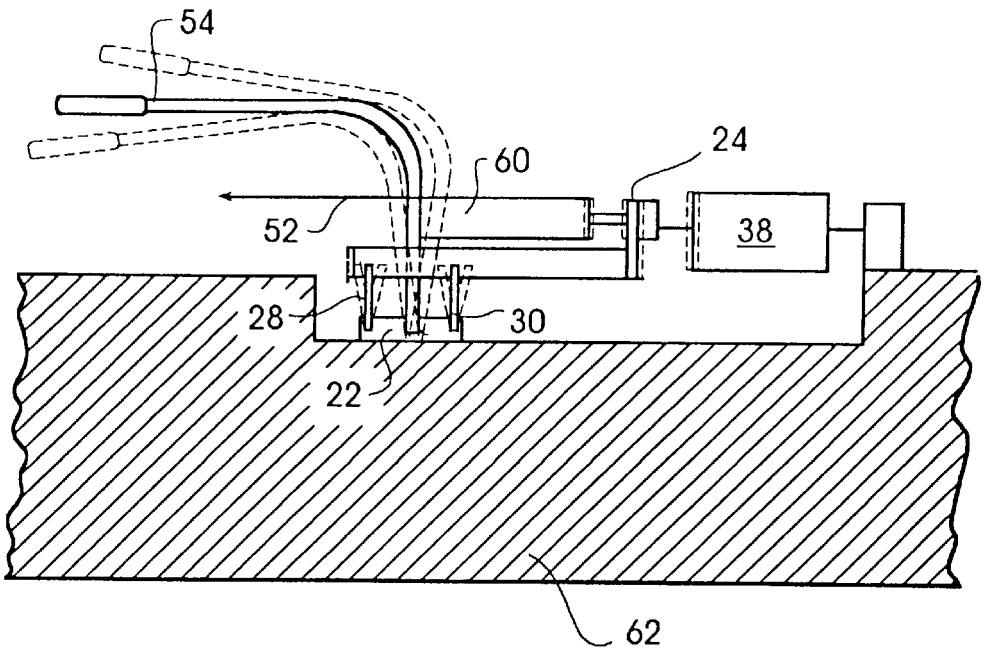
FIG. 12B is a side view that shows an alternative embodiment of the vibrato assembly having two parallel flexures.

FIG. 12B is a schematic drawing of a double flexure vibrato assembly 60. It is identical to single flexure vibrato assembly 58 except that it has two flexures connecting vibrato armature 24 to vibrato base 22. This configuration causes vibrato armature 24 to move with a translating motion instead of a rotating motion. To oppose this translating motion, tension spring 38 mounts parallel to strings 52. In this embodiment, flexures 28 and 30 are placed in compression and must have sufficient stiffness to resist buckling under the applied load.

Figure 13A:
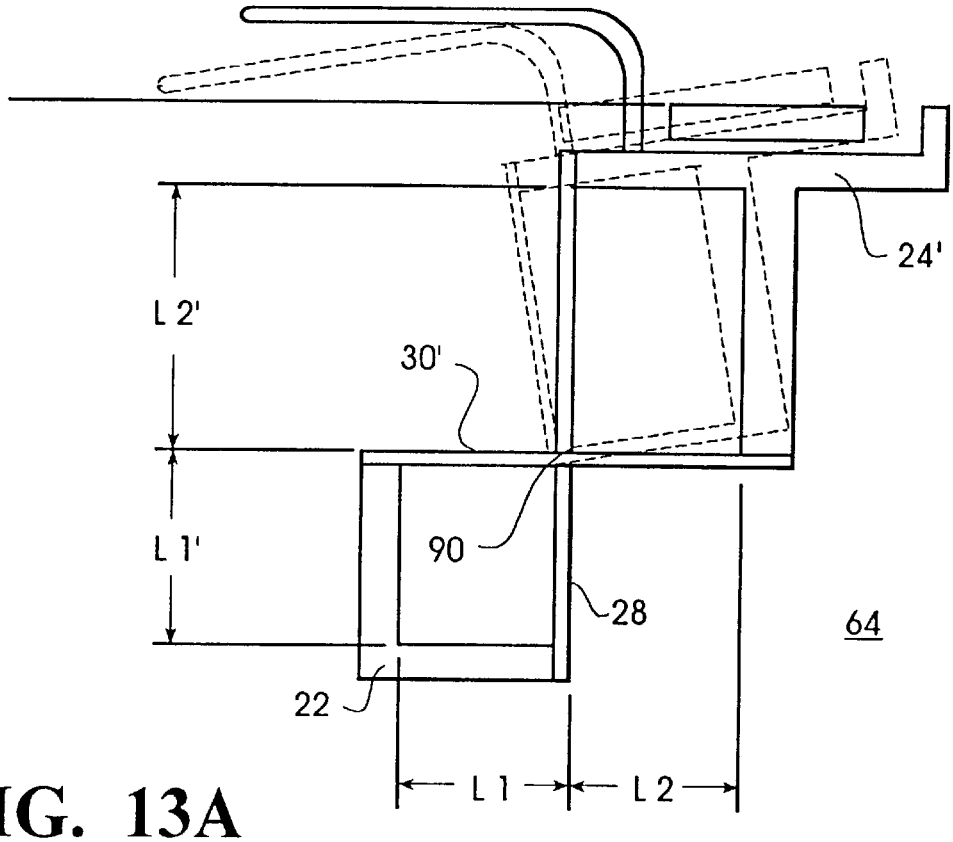
FIG. 13A is a side view that shows an alternative embodiment of the vibrato assembly of the present invention having an asymmetrical flexure arrangement.

FIG. 13A is a schematic drawing of an asymmetrical flexure pivot vibrato assembly 64. In this alternative embodiment, the asymmetrical flexure pivot subassembly is created by asymmetrical flexures 28' and 30' having sections of different lengths L1, L2, L1', and L2'. Asymmetrical vibrato base 22' and asymmetrical vibrato armature 24' are identical to vibrato armature 24 and vibrato base 22 except that they have a slightly different shape to accommodate flexures 28' and 30'. By varying the point of intersection of the flexures 28' and 30', the rotational stiffness increases and the displacement of the axis of rotation decreases. In this embodiment, flexures 28' and 30' are placed in compression and must have sufficient stiffness to resist buckling under the applied load. In FIG. 13A, the distance between the pivot axis 90 and the attachment point of the flexures to the base 22' is different from (less than) the distance between the pivot axis 90 and the attachment point of the flexures to the armature 24'. In contrast, in most other embodiments, the distances between the pivot axis and the attachment points of the flexures are equal.

Figure 13B:
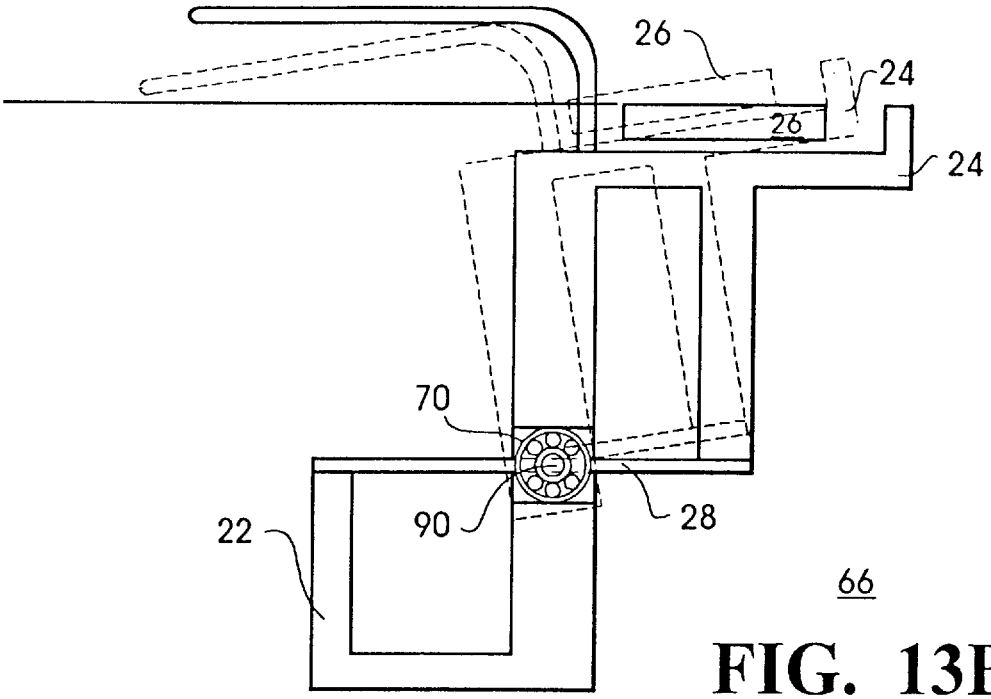
FIG. 13B is a side view that shows an alternative embodiment of the vibrato assembly of the present invention having a combination flexure pivot and radial bearing where the vertical flexure is replaced by a shaft and bearing arrangement.

FIG. 13B is a schematic drawing of a vibrato assembly 66 combining a flexural pivot and a radial bearing. Radial bearing 70 connects a vibrato armature 72 and vibrato base 70 so that vibrato armature 72 can move relative to vibrato base 74. This embodiment has a least one flexure plate 28 connected between vibrato armature 72 and vibrato base 74.

Figure 13C:
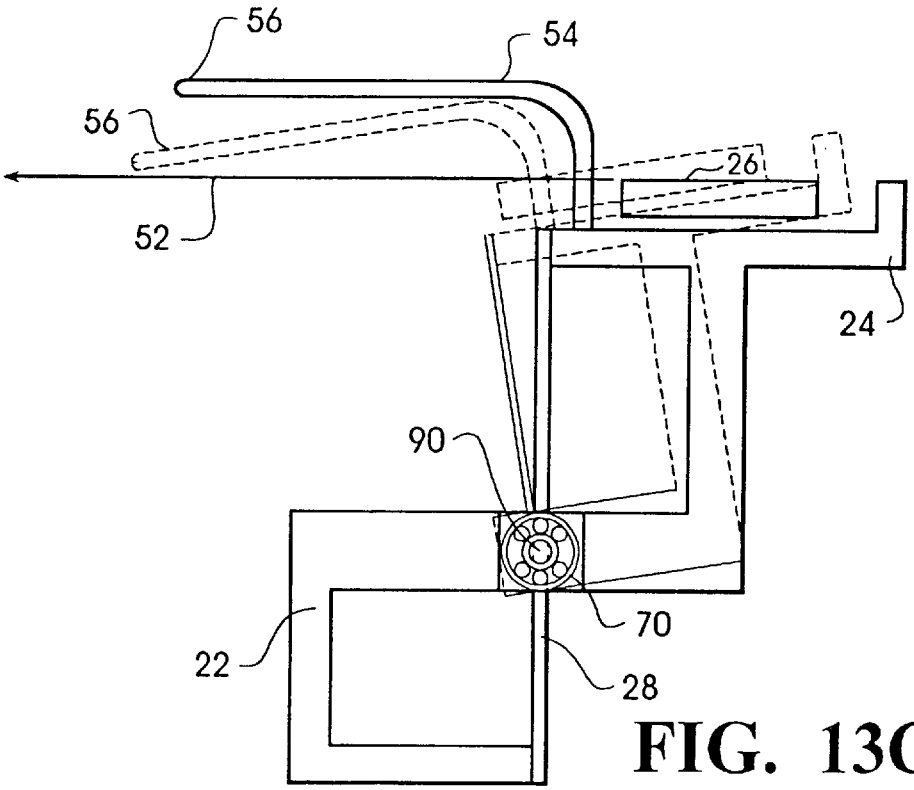
FIG. 13C is a side view that shows an alternative embodiment of the vibrato assembly of the present invention similar to that shown in FIG. 13B except that the flexure bearing and the radial bearing have switched places.

FIG. 13C is a schematic drawing of another configuration of a radial bearing and flexural pivot vibrato assembly 60 with flexure 28 connected in another configuration. There are numerous configurations of this embodiment. The scope of the invention includes embodiments with more than one radial bearing 70 and with radial bearings 70 located in the center of vibrato assembly 66 or at other locations.

Figure 14:
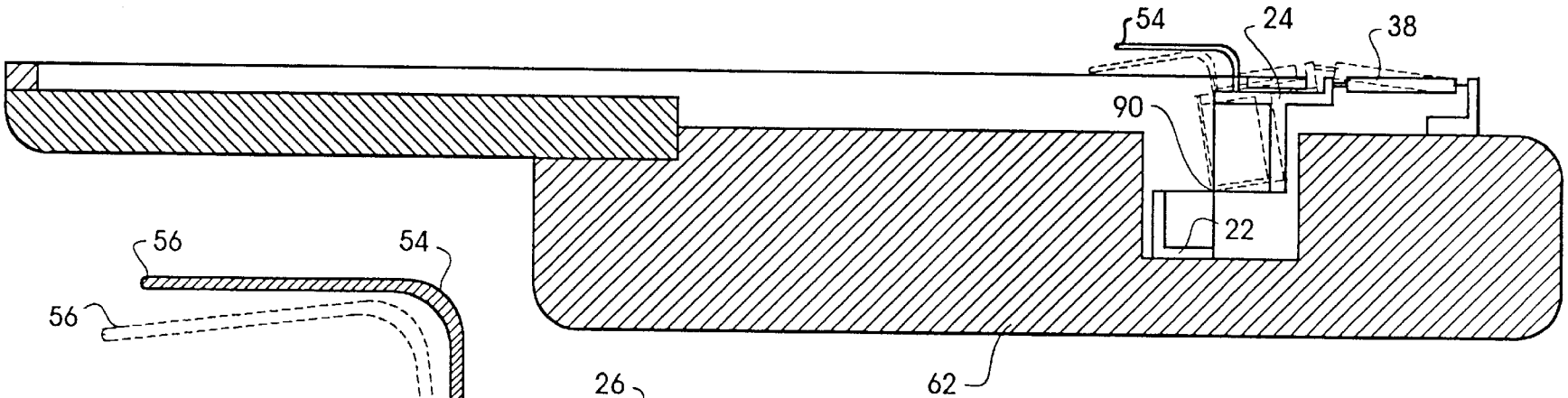
FIG. 14 is a side view that shows a schematic of the vibrato assembly installed in a recess of a body of a stringed instrument with a tension spring in a horizontal position.

FIG. 14 is a schematic of drawing a vibrato assembly installed in an instrument 62. Vibrato base 22 is mounted to the bottom of a recess in the instrument 62. FIG. 14 shows tension spring 38 mounted on top of instrument 62 and parallel to string 52 but it could be mounted in the recess and perpendicular to string 52.

Figure 15:
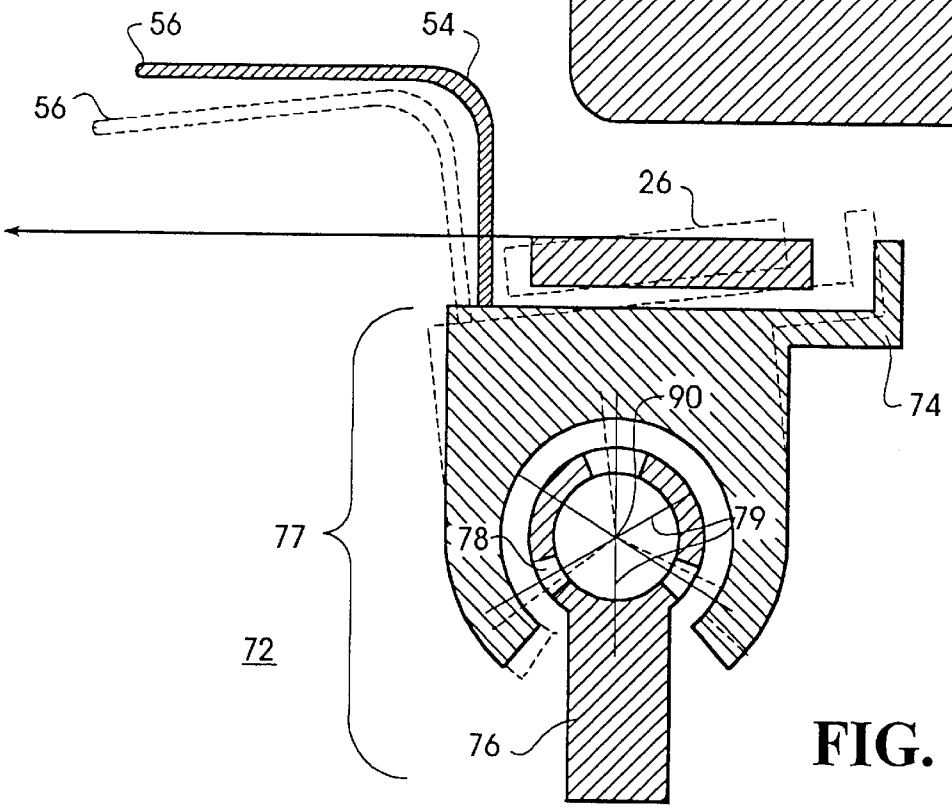
FIG. 15 is a side view that shows an alternative embodiment of the vibrato assembly with a 120° "Y" cross-strip flexure pivot.

FIG. 15 shows a schematic of a Y cross-strip flexure pivot vibrato assembly 72. A Y cross-strip base 76 and a Y cross-strip armature 74 extend into the page and Y cross-strip base 76 flexibly connects to Y cross-strip armature 74 by way of two Y cross-strip flexure pivot subassemblies 77 located at either end of vibrato assembly 72. FIG. 15 shows one of the Y cross-strip flexure pivot assemblies 77. String saddle 26 is mounted to the top of armature 74. Inside a recess of vibrato armature 74 resides base 76. Y cross-strip flexure pivot subassembly 77 consists of three flexure plates 79 positioned 120° apart and attached to vibrato base 76 and to vibrato armature 74 after passing through clearance holes 78. When an actuating force is applied to handle 54, Y cross-strip armature 74 moves around Y cross-strip base 76 as much as clearance holes 78 will allow. FIG. 15 shows flexure plates 79 as if they intersect and connect together, but they are physically separate and have different axial locations (i.e., they are separated in the direction perpendicular to the plane of the drawing). Additionally, the number of flexures plates in a flexure pivot subassembly can exceed three.

Figure 16:
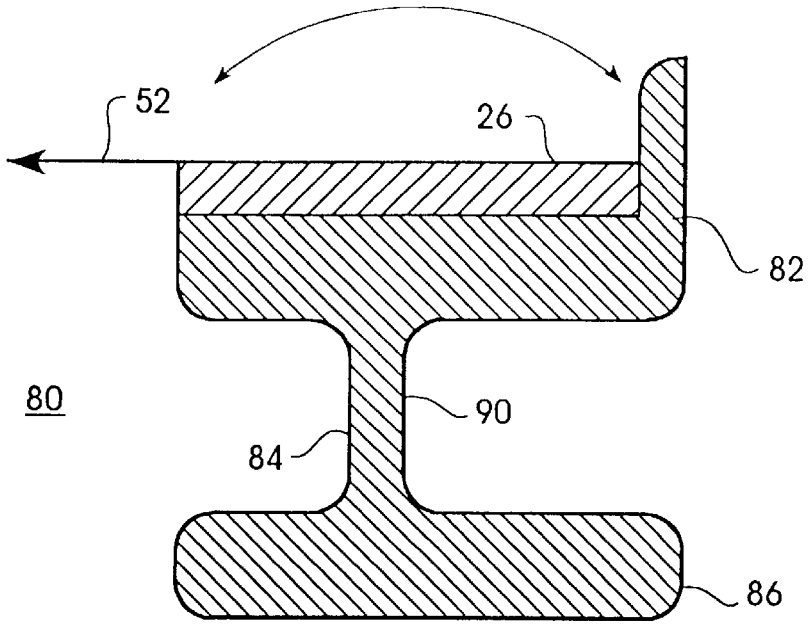
FIG. 16 is a side view that shows an alternative embodiment of the vibrato assembly having a monolithic flexure.

FIG. 16 shows a vibrato assembly having a monolithic structure 80 that incorporates the vibrato armature 82, monolithic flexure 84, and vibrato base 86 into one jointless structure. This design precludes any possibility of friction but is generally expensive to manufacture. Monolithic structure 80 is typically cut from a single piece of material. Simple configurations, such as the one shown in FIG. 16, can be fabricated using conventional machining operations. More complex configurations may require alternative processes such as wire EDM (electrical discharge machining) followed by chemical deburring. After monolithic structure 80 is machined, flexure 84 can be locally heat treated with a laser to give it the desired hardness. The scope of the invention includes the substitution of monolithic flexures for clamped-flat-spring flexures in all embodiments.

The scope of the invention includes vibrato assemblies that vary the tension of all strings of an instrument at once and those that vary the tension of a subset of all the strings at once. For example, a six string instrument could have six separate vibrato assemblies similar to vibrato assembly 20 shown in FIG. 9. In this embodiment, each vibrato assembly supports and varies the tension in one string. Additionally, this six string instrument could have three vibrato assemblies where each vibrato assembly varies the tension of two strings 52, et cetera. These individual flexure pivot vibrato assemblies can be separately actuated or jointly actuated by a lever arm (i.e., handle), foot linkage mechanism, and/or a mechanical actuator.

Figure 18:
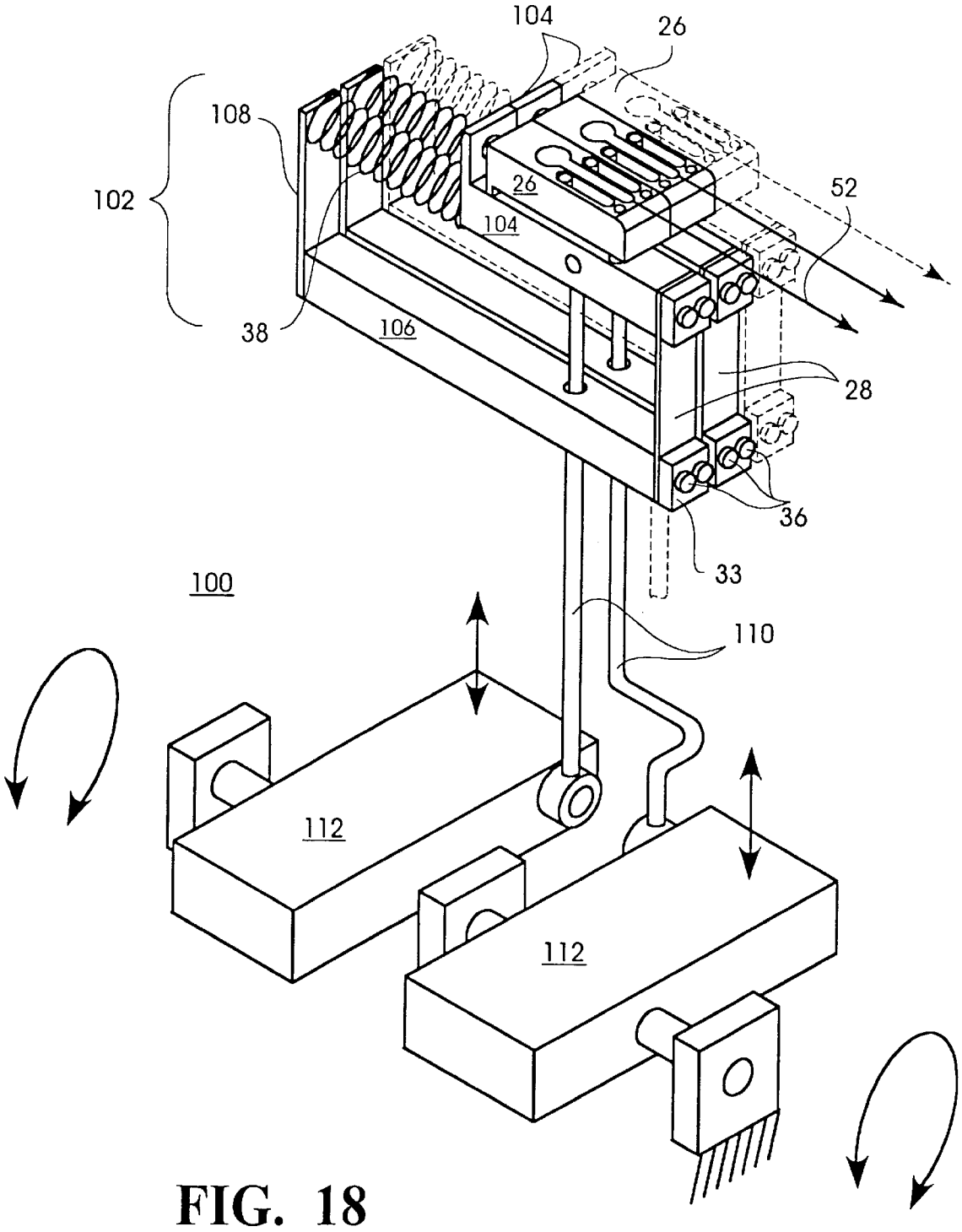
FIG. 18 is a perspective view that shows an assembly of individually actuated vibratos, which vary the tension of each string independently of the others.

FIG. 18 shows an embodiment of the above described concept. The tension of each string 52 is varied independently of the tension of the other strings 52 by an assembly of individually actuated vibratos 100 that have a singular vibrato assembly 102 for each string 52. Each singular vibrato assembly 102 has a singular armature 104 with a saddle 26 mounted to it that supports and anchors string 52, a singular base 106 that is immovably attached to the instrument (not shown), a spring 38 connected between singular armature 104 and singular tension spring connection plate 108, and an elastic flexure plate 28 that connects to armature 104 and base 106 with clamps 33 and fasteners 36 described previously.

Each singular vibrato armature 104 connects to a foot pedal 112 through a connecting rod 110. When foot pedal 112 is depressed, connecting rod 110 pulls singular armature 104 down (or pushes singular armature 104 up) and causes flexure plate 28 to bend about the x-axis, shown in FIG. 17, with the top portion of flexure plate 28 bending towards spring 38 (or bending away from spring 38). This displacement of singular armature 104 increases (or decreases) the tension of string 52 and increases (decreases) the pitch of its tone. When the actuating force is removed from foot pedal 112, singular armature 104 returns to its original position and restores the tension of string 52 and the pitch of its tone to their original values. FIG. 18 shows two individually actuated vibratos 102 and a third individually actuated vibrato 102 with phantom lines. The scope of the invention includes instruments having any number of individually actuated vibratos 102 and includes instruments having individually actuated vibratos that vary the tension of two or more strings at once. Additionally, the scope of the invention includes instruments that replace the foot pedal with a handle or a machine activated device.

Figure 19A:
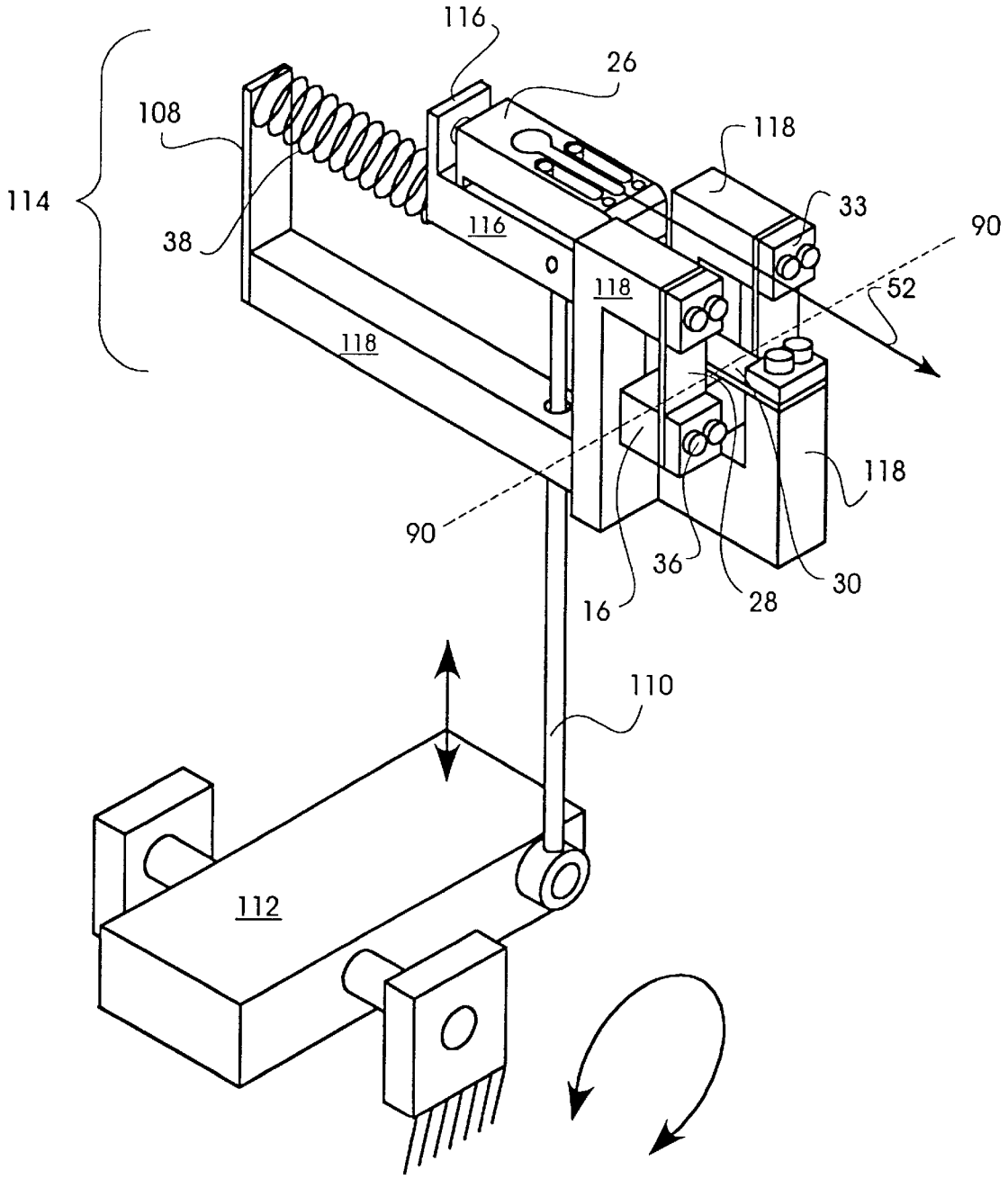
FIG. 19A is a perspective view that shows a preferred embodiment of an individually actuated vibrato.
Figure 22:
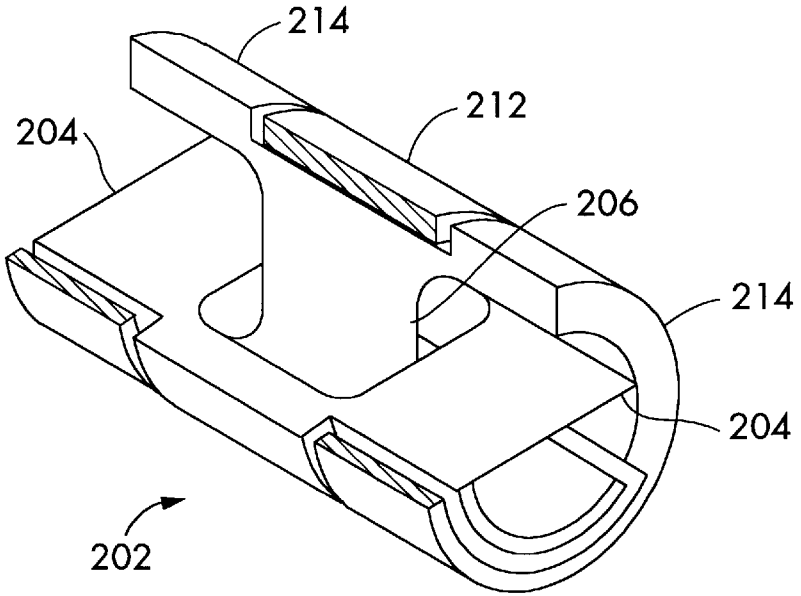
FIG. 22 is a perspective view, partially cut away, of a double-ended-type modular flexural pivot used on an alternative embodiment of the vibrato assembly of the present invention.
Figure 21:
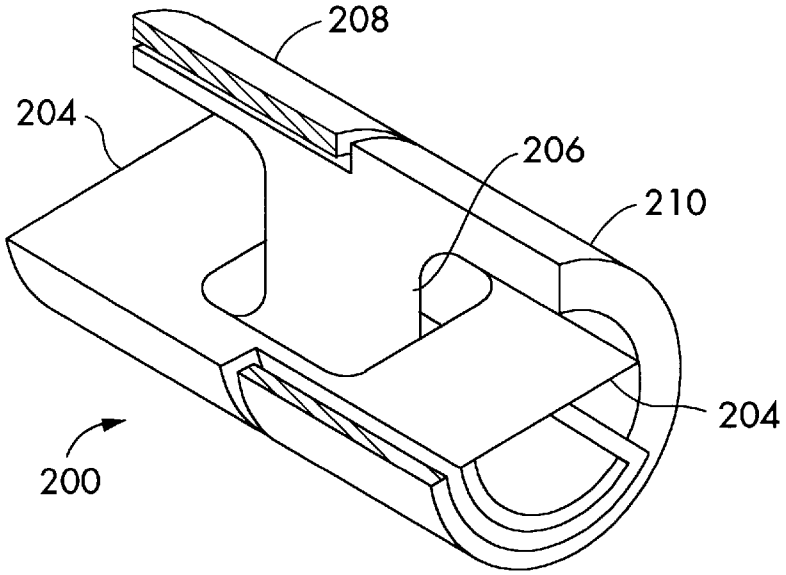
FIG. 21 is a perspective view, partially cut away, of a cantilever-type modular flexural pivot used on an alternative embodiment of the vibrato assembly of the present invention.

FIGS. 19A and 19B show the preferred embodiment of an individually actuated vibrato 114 that uses three flexures in a cross-strip configuration. As stated previously, cross-strip configurations have the advantage of a well defined axis of rotation and rigidity at the expense of greater complexity. Saddle 26 mounts to a preferred embodiment of a singular armature 116. FIG. 19B shows that the bottoms of two vertical flexure plates 28 and one end of horizontal flexure 30 connect to singular armature 116 using clamps 33 and fasteners 36 mentioned previously. The other end of flexures 28 and 30 connect to singular base 118. Similar to previously described embodiments, spring 38 attaches between singular armature 116 and tension spring connection plate 108 that fastens to singular base 118. The horizontally positioned spring 38 counterbalances the tension in string 52 in this embodiment and that shown in FIG. 18.

The preferred embodiment of singular base 118 mounts on the instrument and does not move. When an actuating force is applied to connecting rod 110, whether it be by a foot pedal 112, a handle, or a machine; singular vibrato armature 116 moves downward (or upward) and rotates in one of the directions shown by the arrows in FIG. 19B. Flexures 28 and 30 bend about a pivot axis 90 with the top of flexures 28 rotating towards (or away from) spring 38. FIGS. 19A and 19B show one individually actuated vibrato 114 to simplify the drawings. In actual use, an instrument could have as many individually actuated vibratos 114 as strings or individually actuated vibratos 114 could be modified to anchor, support and the vary the tension in several strings at once.

FIGS. 23–28 illustrate the use of a modular flexural pivot in the vibrato assembly of the present invention. Modular flexural pivots are available in two types; a cantilever type 200 shown in FIG. 21 and a double-ended type 202 shown in FIG. 22. In both types, two flat crossed flexures 204 and 206 are contained within a split tubular housing that has rotating sleeves. In the cantilever-type modular flexural pivot 200, the housing has two ends 208 and 210, which can rotate with respect to each other. In the double-ended-type modular flexural pivot 202, the housing has a center section 212 that rotates with respect to two end sections 214. Modular flexural pivots are available commercially from Lucas Aerospace Power Transmission Corporation of Utica, N.Y., and are sold under the trademark FREE-FLEX PIVOT frictionless bearing.

Figure 23:
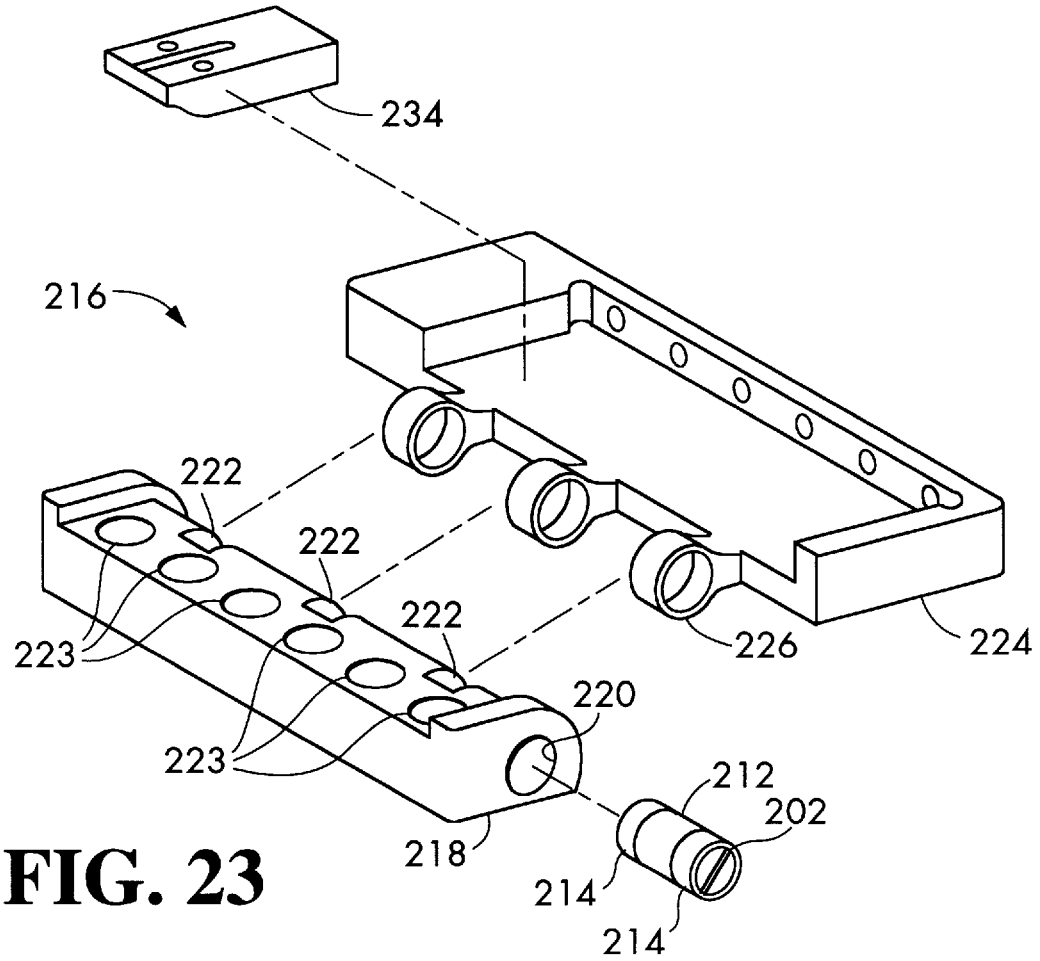
FIG. 23 is an exploded perspective view of an embodiment of the vibrato assembly that uses the double-ended-type modular flexural pivot of FIG. 22.
Figure 24:
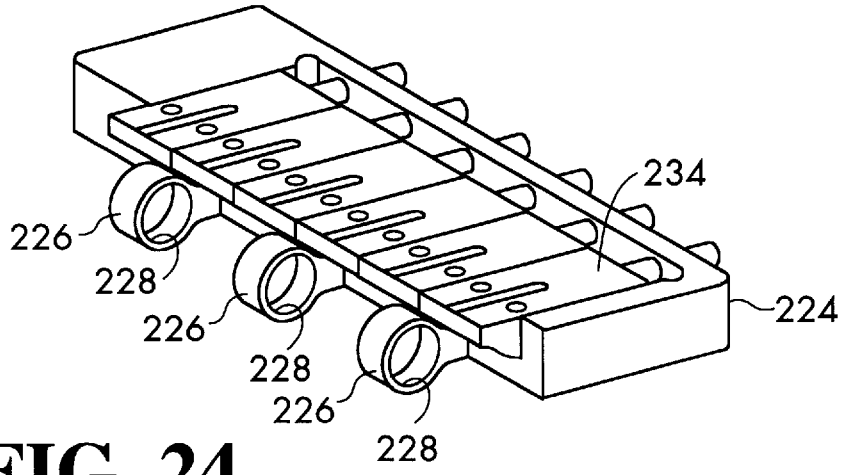
FIG. 24 is a perspective view of a vibrato armature used in the vibrato assembly of FIG. 23.
Figure 25:
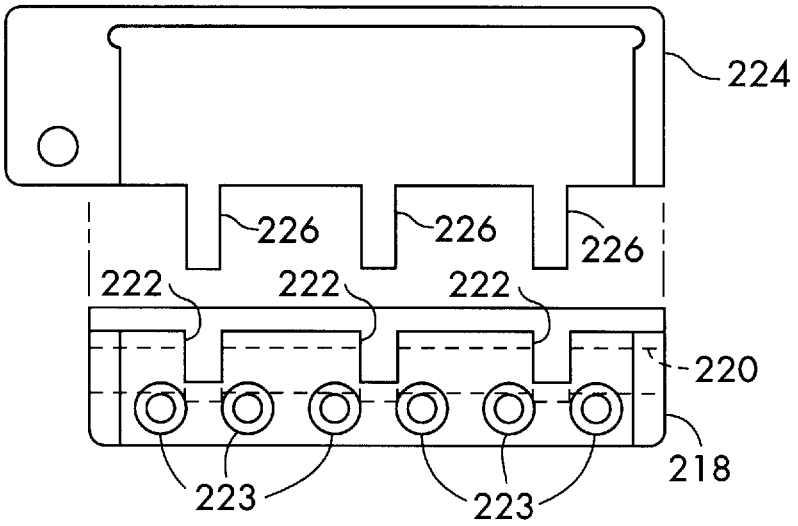
FIG. 25 is an exploded plan view of the vibrato assembly of FIG. 23.
Figure 26:
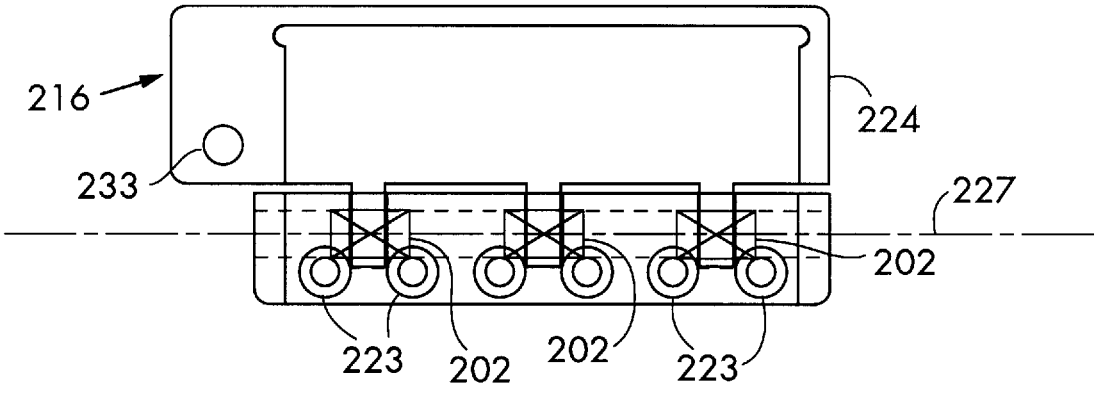
FIG. 26 is a plan view of the vibrato assembly of FIG. 23.

FIGS. 23–28 show a vibrato assembly 216 that uses three double-ended-type modular flexural pivots 202. As best shown in FIGS. 23 and 26, the vibrato base 218 has a through hole 220 and three slots 222. Each modular flexural pivot 202 is centered at a slot 222, with the bore of the hole 220 engaging the end sections 214 of the pivot. The vibrato base 218 is mounted to the instrument by fasteners 221 (FIG. 28) that fit into through holes 223 (FIGS. 23, 25, 26).

The vibrato armature 224 has three knuckles 226 extending outward, each of which has a through hole 228. When the armature 224 is assembled with the base 218, the knuckles 226 of the armature engage the center sections 212 of the pivots 202, as shown in FIG. 26. The pivots 202 define a pivot axis 227. The preferred orientation of the modular flexural pivots 202 is with the flexures positioned at 45 degrees to the string 230, as shown in FIG. 27, which evenly loads both flexures in compression.

The modular flexural pivots 200 or 202 may be secured in a number of different ways. Preferably, the modular flexural pivots are a press fit or a thermal shrink fit into their mounting holes. In a press fit, the modular flexural pivots are installed using a press, but care must be taken not to damage the pivots. In a thermal shrink fit, the modular pivots are cooled and/or the base and armature are heated prior to installation of the pivots; the pivots are tightly held in their mounting holes when the temperatures equalize. Alternatively, the modular flexural pivots could be clamped or secured with pins or set screws, or they could be secured with adhesives or other bonding technique.

The illustrated embodiment using the modular flexural pivots 200 or 202 shows the use of three such pivots, but other numbers of pivots, such as a single pivot, and pivots having different dimensions or proportions could also be used and is within the scope of the invention.

Figure 27:
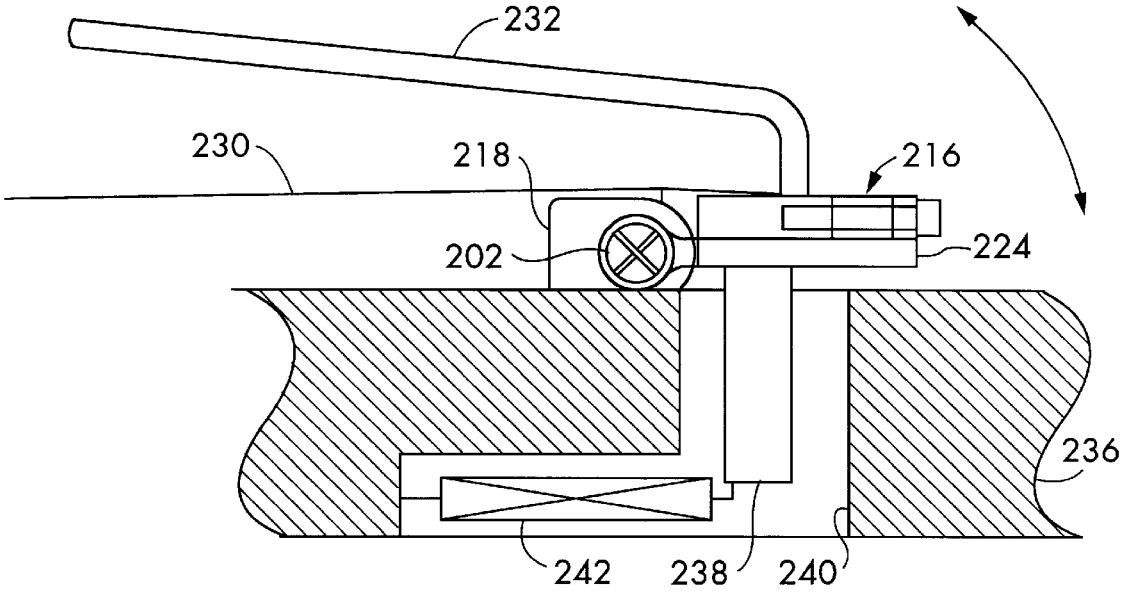
FIG. 27 is a side view of the vibrato assembly of FIG. 23 as installed in a stringed instrument.
Figure 28:
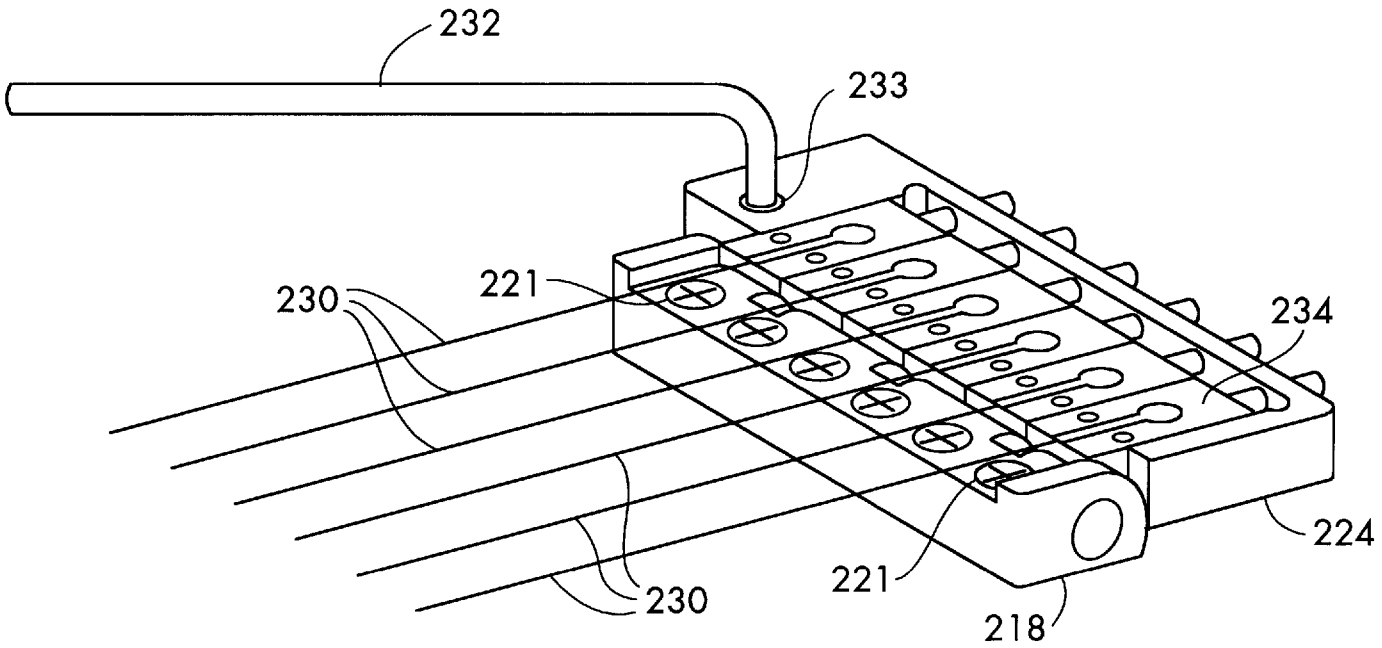
FIG. 28 is a perspective view of the vibrato assembly of FIG. 23, showing attached strings.

FIGS. 27 and 28 show the vibrato assembly 216 with attached strings 230 and a handle 232. The handle 232 fits into hole 233 (FIG. 26) in the armature 224. String saddles 234 (FIGS. 23, 24, and 28) are mounted to the top of the armature 224 for attaching the strings 230 to it. FIG. 27 shows the vibrato assembly 216 mounted on a stringed instrument 236. A link 238 is rigidly attached to the armature 224 and extends downward into a cavity 240 within the instrument 236. A tension spring 242 (or multiple springs) provides a force on the armature 224 and link 238 to counter the tension in the strings 230.

The vibrato assembly 216 operates in the same manner as described above, by providing a rigid, yet friction-free pivot between the armature 224 and the base 218. The modular flexural pivots 202 provide a low-cost way to build a cross-strip flexure pivot subassembly.

All publications and patent applications cited in the specification are herein incorporated by reference as if each publication or patent application were specifically and individually indicated to be incorporated by reference.

The foregoing description of the preferred embodiment of the present invention has been presented for the purposes of illustration and description. It is not intended to be exhaustive nor to limit the invention to the precise form disclosed obviously many modifications and variations are possible in light of the above teachings. For example, the flexures may be loaded in tension, in compression, or some combination thereof, all of which is within the scope of the invention. The embodiments were chosen in order to best explain the best mode of the invention. Thus, it is intended that the scope of the invention to be defined by the claims appended hereto.

What is claimed is:

1. A vibrato assembly for an instrument having one or more strings, comprising:

a. a vibrato base attached to the instrument;

b. a vibrato armature attached to at least one of the strings and coupled to the vibrato base for movement relative thereto;

c. a flexure having a first portion fixed relative to the vibrato base and a second portion fixed relative to the vibrato armature to flexibly couple the vibrato armature to the vibrato base by bending of the flexure and d. means separate from the flexure for providing a force on the vibrato armature to counter tension in the strings.

2. A vibrato assembly as recited in claim 1 wherein the flexure is a flexure pivot having two flexure plates each having two ends, and wherein one end of each flexure plate is fixed relative to the vibrato armature and the other end is fixed relative to the vibrato base, and wherein the two flexure plates are oriented in different planes.

3. A vibrato assembly as recited in claim 2 wherein the flexure includes two flexure pivots disposed at opposite sides of the assembly.

4. A vibrato assembly as recited in claim 2 wherein the two flexure plates intersect along a pivot axis, and wherein each flexure has a length between the pivot axis and an attachment to the vibrato armature that equals a length between the pivot axis and an attachment to the vibrato base.

5. A vibrato assembly as recited in claim 1 further comprising a handle having one end thereof coupled to the vibrato armature.

6. A vibrato assembly as recited in claim 1 wherein the flexure includes a modular flexural pivot disposed between and coupled to the vibrato base and vibrato armature, wherein the modular flexural pivot has a split housing with one portion of the split housing fixed to the vibrato base and another portion of the split housing fixed to the vibrato armature.

7. A vibrato assembly as recited in claim 1 wherein the flexure includes a plurality of modular flexural pivots disposed along a pivot axis between the vibrato base and vibrato armature.

8. A vibrato assembly for an instrument having one or more strings, comprising:

a. a vibrato base attached to the instrument;

b. a vibrato armature attached to at least one of the strings and coupled to the vibrato base for movement relative thereto; and c. a modular flexural pivot having a first tubular portion fixed relative to the vibrato base and a second tubular portion fixed relative to the vibrato armature to flexibly couple the vibrato armature to the vibrato base, wherein the modular flexural pivot includes two crossed flexure plates that permit relative rotation of the tubular portions by bending of the flexure plates.

9. A vibrato assembly for an instrument having one or more strings, comprising:

a. a vibrato base attached to the instrument;

b. a vibrato armature attached to the strings and coupled to the vibrato base for movement relative thereto; and c. a flexure pivot that flexibly couples the vibrato armature to the vibrato base including two flexure plates oriented in different planes and each having two ends, wherein one end of each flexure plate is fixed to the vibrato armature and the other end is fixed to the vibrato base.

10. A vibrato assembly as recited in claim 9 wherein the two flexure plates intersect along a pivot axis, and wherein each flexure plate has a length between the pivot axis and an attachment to the vibrato armature that equals a length between the pivot axis and an attachment to the vibrato base.

11. A vibrato assembly as recited in claim 9 wherein the flexure pivot is a modular flexural pivot having a split housing with one portion of the split housing fixed to the vibrato base and another portion of the split housing fixed to the vibrato armature.

12. A vibrato assembly as recited in claim 11 wherein the flexure pivot includes a plurality of modular flexural pivots disposed along a pivot axis between the vibrato base and vibrato armature.

13. A vibrato assembly for an instrument having one or more strings, comprising:

a. a vibrato base attached to the instrument;

b. a vibrato armature attached to the strings and coupled to the vibrato base for rotational movement along a pivot axis; and c. a modular flexural pivot having a split housing with one portion of the split housing fixed to the vibrato base and another portion of the split housing fixed to the vibrato armature.

14. A vibrato assembly as recited in claim 13 wherein the split housing is tubular and the modular flexural pivot has a first tubular portion coupled to the vibrato base and a second tubular portion coupled to the vibrato armature and has at least one flexure plate disposed between the two tubular portions.

15. A vibrato assembly as recited in claim 13 further comprising a second modular flexural pivot, and wherein the modular flexural pivots are disposed at opposite sides of the assembly along the pivot axis.

* * * * *